US007638250B2

(12) United States Patent
Honda et al.

(10) Patent No.: US 7,638,250 B2
(45) **Date of Patent: *Dec. 29, 2009**

(54) TONER, DEVELOPING DEVICE, IMAGE FORMING APPARATUS, AND IMAGE FORMING METHOD USING THE TONER

(75) Inventors: Takahiro Honda, Fujinomiya (JP); Hiroyuki Fushimi, Numazu (JP); Osamu Uchinokura, Mishima (JP)

(73) Assignee: Ricoh Company Limited, Tokyo (JP)

( * ) Notice: Subject to any disclaimer, the term of this patent is extended or adjusted under 35 U.S.C. 154(b) by 343 days.

This patent is subject to a terminal disclaimer.

(21) Appl. No.: 11/685,838

(22) Filed: Mar. 14, 2007

(65) Prior Publication Data

US 2007/0218389 A1 Sep. 20, 2007

(30) Foreign Application Priority Data

Mar. 17, 2006 (JP) ..... 2006-075529

(51) Int. Cl.
*G03G 9/08* (2006.01)

(52) U.S. Cl. ..... 430/108.22; 430/109.4; 430/108.4; 430/108.5; 430/123.5

(58) Field of Classification Search ..... 430/108.22, 430/108.4, 108.5, 109.4, 123.5
See application file for complete search history.

(56) References Cited

U.S. PATENT DOCUMENTS

| | | | | |
|---|---|---|---|---|
| 6,479,204 | B1 | 11/2002 | Uchinokura et al. | |
| 6,503,676 | B2 | 1/2003 | Yamashita et al. | |
| 6,641,969 | B2 | 11/2003 | Uchinokura et al. | |
| 6,818,370 | B2 * | 11/2004 | Uchinokura et al. | 430/108.22 |
| 2004/0254330 | A1 * | 12/2004 | Duan et al. | 528/275 |
| 2006/0167214 | A1 * | 7/2006 | Terauchi et al. | 528/272 |

FOREIGN PATENT DOCUMENTS

| | | | |
|---|---|---|---|
| JP | 60-090344 | | 5/1985 |
| JP | 64-015755 | | 1/1989 |
| JP | 02-082267 | | 3/1990 |
| JP | 02-198456 | | 8/1990 |
| JP | 02-205858 | | 8/1990 |
| JP | 02-269364 | | 11/1990 |
| JP | 03-041470 | | 2/1991 |
| JP | 03-229264 | | 10/1991 |
| JP | 2004-163836 | | 6/2004 |
| WO | WO-2007/052725 | * | 5/2007 |

OTHER PUBLICATIONS

U.S. Appl. No. 12/203,278, filed Sep. 3, 2008, Yamada, et al.
U.S. Appl. No. 12/040,451, filed Feb. 29, 2008, Saitoh, et al.
U.S. Appl. No. 12/048,823, filed Mar. 14, 2008, Honda, et al.
U.S. Appl. No. 12/047,807, filed Mar. 13, 2008, Honda, et al.
U.S. Appl. No. 11/782,167, filed Jul. 24, 2007, Fushimi, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner is provided including a colorant; a binder resin (A) which is a polyester resin having no tetrahydrofuran insoluble component, and having a molecular weight distribution such that components having a molecular weight of not greater than 500 are included in an amount of not greater than 4% by weight and a peak is present in a molecular weight range of from 3,000 to 9,000 when measured by gel permeation chromatography (GPC); and a binder resin (B) which is a polyester resin having no tetrahydrofuran insoluble component, and including units of a polycarboxylic acid and a diol having the specific formula; wherein at least one of the binder resins (A) and (B) is prepared in the presence of the specific titanium-containing catalyst, and wherein a weight ratio ((A)/(B)) of the binder resin (A) to the binder resin (B) is from 60/40 to 85/15.

20 Claims, 3 Drawing Sheets

TONER, DEVELOPING DEVICE, IMAGE FORMING APPARATUS, AND IMAGE FORMING METHOD USING THE TONER

BACKGROUND OF THE INVENTION

1. Field of the Invention

The present invention relates to a toner for use in electrophotography. In addition, the present invention also relates to a developing device, an image forming apparatus, and an image forming method using the toner.

2. Discussion of the Background

Recently, the development of office automation and colorization of documents have been remarkable. The need to print a document including figures (such as graphs made by a personal computer) by a printer and then copying the printed document to prepare materials for use in a presentation, has been increasing, as well as the need to copy conventional full text documents. Because images produced by printers typically include solid images, line images and half tone images, printers are required to produce high quality solid, line and half tone images. In addition, printers are required to have high reliability.

In electrophotography, a developer is at once adhered to an electrostatic latent image formed on an image bearing member (e.g., a photoreceptor), and the resultant image is then transferred from the image bearing member onto a transfer medium such as a transfer paper, and finally fixed on the transfer paper. As the developer configured to develop the electrostatic latent image formed on the image bearing member, a two-component developer including a carrier and a toner and a one-component developer consisting essentially of a toner (e.g., magnetic toner and non-magnetic toner) are known. The two-component developer has the following drawbacks:

(1) Toner particles tend to adhere to the carrier, resulting in deterioration of charging property of the developer; and (2) Because only the toner is consumed in a developing process, a device for controlling the toner concentration of the developer is needed, resulting in upsizing of a developing device.

In contrast, the one-component developer has no above-mentioned drawbacks while having advantages over the two-component developer such that an image forming apparatus can be small in size, etc. Therefore, the one-component developer has been mainly used recently.

The one-component developers are broadly classified into two categories: a magnetic one-component developer consisting essentially of a magnetic toner and an on-magnetic one-component developer consisting essentially of a non-magnetic toner.

In a magnetic one-component developing method using a magnetic one-component developer, a magnetic toner including a magnetic material (such as ferrite) is held on a developing sleeve, containing a magnetic field generating mechanism (such as magnets) therein, generating a magnetic field by the magnetic force thereof, and then a thin toner layer is formed by a toner layer thickness control member to develop an electrostatic latent image. The magnetic one-component developing method is broadly used recently in compact printers.

On the other hand, in a non-magnetic one-component developing method using a non-magnetic one-component developer, a non-magnetic toner is fed on a developing sleeve by pressing a toner supply roller thereto. Thereby, the toner is held on the developing sleeve due to the electric force, and then a thin toner layer is formed by a toner layer thickness control member to develop an electrostatic latent image. The Non-magnetic one-component developing method is widely used for compact full-color printers because of having the following advantages:

(1) The non-magnetic toner includes no magnetic material which is typically colored, and therefore a toner having good color reproducibility can be provided; and (2) The developing device can be small in size and the manufacturing cost thereof can be reduced because the developing sleeve includes no magnet.

However, the one-component developing method also has some drawbacks. In the two-component developing method, a carrier stably charges and transports a toner. In other words, a toner is transported to a developing sleeve to be developed after being sufficiently mixed with a carrier in a developing device. Therefore, the toner can be stably charged and transported even after a long repeated use. In addition, the two-component developing method can be easily applied to high-speed machines.

In contrast, in the one-component developing method, there is no mechanism for stably charging and transporting a toner. Therefore, the toner cannot be stably charged and transported especially after a long repeated use, or when used in high-speed machines. In the one-component developing method, a toner is transported to a developing sleeve and then a thin toner layer is formed by a toner layer thickness control member, as mentioned above. In this case, a charging time in which the toner is contact-charged or friction-charged by frictional charging members (such as the developing sleeve and the toner layer thickness control member) is too short. Therefore, weakly or reversely charged toner particles are easily produced in the one-component developing method as compared with the two-component developing method.

In particular, in the non-magnetic one-component developing method, the toner is transported by at least one toner transport device to develop the electrostatic latent image formed on the image bearing member. In this case, the thickness of the toner layer held on the toner transport device is preferably as thin as possible. If the toner layer is too thick, all over the toner layer cannot be uniformly charged, while only surface portion thereof is charged. The non-magnetic one-component developer is required to be quickly charged and maintain an appropriate amount of the charge.

In the non-magnetic one-component developing method, materials used for the toner supply member, the toner layer thickness control member, the developing sleeve, etc., should be selected in view of giving a large amount of charge to the toner, because the toner is charged by pressing the above members thereto. The binder resin, which is the main component of the toner, is required to have good resistance to a mechanical impactive force in order to produce highly reliable images for a long period of the time. The toner tends to generate heat when frictionized, and then adhere to a charging member and shorten the life of the developing sleeve. As a result, the toner cannot be stably charged after long repeated use. Alternatively, the toner particles tend to be pulverized in the developing device, and therefore ultrafine particles are produced. As a result, the resultant image density decreases and white spots appear therein. For these reasons, a process cartridge (i.e., an image forming unit) used for the non-magnetic one-component developing method cannot be used for a long period of the time, and has to be replaced with a new one only after several thousands copies are produced.

In attempting to solve the above problems, published unexamined Japanese patent applications Nos. (hereinafter referred to as JP-A) 02-205858 and 02-198456 have disclosed toners including an initial toner and a supply toner, wherein the kind, amount, surface treatment agent used, etc., of each of the additives is different so that the initial and supply toners have different charge quantity. It is described therein that the toner in the developer can keep a constant charge quantity and such a developer can produce stable images. But the charge quantity of the toner can be controlled only at the first occasion of supplying the supply toner, and cannot be controlled at the second or later occasions. In addition, durability of the toner is insufficient.

The thermal property of the binder resin of the toner is important in the fixing process. A pressure heat fixing method using a heat roller, etc., is widely used for the fixing process. In this method, the surface of the heat roller contacts a toner image formed on a transfer member upon application of pressure thereto to fix the toner image on the transfer member. The toner image can be rapidly fixed on the transfer member because of high thermal efficiency of this method, and therefore this method is preferably used for high-speed machines. When the toner is used for high-speed machines, the toner is required to have low-temperature fixability (a property in which the minimum fixable temperature is low). Such a toner can be obtained using a binder resin having a low softening point.

When the heat roller contacts the toner image, an offset problem in that part of the fused toner image is adhered to the surface of the heat roller, and then the part of the toner image is re-transferred to an undesired portion of the transfer member itself or the following sheet of the paper, etc., tends to occur. In attempting to prevent the occurrence of the offset problem, a method in which a surface of the heat roller is formed by a releasable material, and a method in which a liquid release agent such as a silicone oil is further applied to the surface of the heat roller are proposed. These methods are effective in improving hot offset resistance, but do not contribute to the improvement of low-temperature fixability, separativeness, preservation stability, etc.

In a typical full-color image forming process, at least 3 toner images (i.e., a magenta, a cyan, and a yellow toner images, optionally a black toner image) are independently developed and transferred, and then these toner images are overlaid on a transfer medium. The overlaid toner image is fixed thereon at once to form a full-color image. Since the full-color image consists of plural toner layers and has a large thickness, there are some drawbacks that cracks tends to appear on the image, the glossiness of the image tends to decrease, and image defects tend to occur when the image is folded. For these reasons, the toner for use in the full-color image is required to have an appropriate physical strength and a property of producing high glossiness images.

The fixability of a toner is typically depends on the physical properties of the binder resin, which is the main component of the toner. A styrene-acrylic resin and a polyester resin are typically used as a binder resin of a toner. It is typically known that a toner using a styrene-acrylic resin is suitable for producing low-glossiness images because the styrene-acrylic resin has a high softening point, but the low-temperature fixability and the resultant image strength thereof are less than those of a toner using a polyester resin.

A toner using a polyester resin has good low-temperature fixability, but has poor hot offset resistance. In attempting to improve the hot offset resistance of the toner, methods of increasing surface cohesive force thereof such as increasing the polymerization degree of the binder resin, using a multivalent monomer to be cross-linked, and introducing a gel component to the resin are proposed. However, these methods deteriorate not only low-temperature fixability of the resultant toner but also pulverization property thereof in the manufacturing process. Recently, toners are being modified to have a smaller particle diameter so as to produce high quality images. Since polyester resins and polyol resins have high molecular cohesive force, these resins have poor pulverization property in the toner manufacturing process, and tend to adhere to or aggregate on the inside walls of the pulverizer.

The smaller particle diameter a toner has, the larger van der Waals' force the toner has. Therefore, the toner particles easily aggregate and deteriorate the classification efficiency. As a result, the manufacturing efficiency deteriorates and the manufacturing cost increases.

In attempting to improve pulverization property of a toner, a method in which the molecular weight of a binder resin is decreased is proposed, but thereby the glass transition temperature typically decreases. When the glass transition temperature is too low, the resultant toner has poor preservation stability, i.e., blocking resistance. Further, there are drawbacks that resistance to the offset problem in that a toner adhered to a heat roller is re-transferred to the following sheet of a recording material deteriorates, and the strength of the fixed images deteriorates.

JP-A 02-269364 discloses a polyester resin including diol units of a polyoxyethylene-based bisphenol A and a polyoxypropylene-based bisphenol A. A toner including such a resin has poor low-temperature fixability and preservation stability, and cracks tend to appear on the resultant full-color image.

In attempting to solve these problems, toners including two different polyester resins are proposed. For example, JP-A 60-90344 discloses a toner including a non-linear polyester resin and a linear polyester resin. JP-A 64-15755 disclose a toner binder resin including a cross-linked polyester resin having a glass transition temperature of not less than 50° C. and a softening point of not greater than 200° C. and a straight-chain polyester resin having a softening point of not greater than 150° C. and a weight average molecular weight of from 3,000 to 50,000. JP-A 02-82267 discloses a toner including anon-linear high-molecular-weight polyester resin having a weight average molecular weight (Mw) of not less than 5,000 and a dispersion degree (Mw/Mn) of not less than 20 and a non-linear low-molecular-weight polyester resin having a weight average molecular weight (Mw) of from 1,000 to 5,000 and a dispersion degree (Mw/Mn) of not greater than 4. JP-A 03-229264 discloses a toner including a linear polyester resin having an acid value of from 5 to 60, a non-linear polyester resin having an acid value of less than 5, and an organic metal compound. JP-A 03-41470 discloses a toner including two different saturated polyester resins in which the ratio of the acid value there between is not less than 1.5. Although each of these toners has good fixability, impactive force resistance thereof is insufficient for use in the one-component developing method.

In attempting to solve this problem, JP-A 2004-163836 discloses a toner including a polyester resin having a specific diol units and another polyester resin having a different molecular weight. However, fixability and preservation stability thereof are insufficient.

As mentioned above, the non-magnetic one-component developing method has an advantage that the developing device can be small in size. But a toner used for the non-magnetic one-component developing method, which has a good combination of durability, fixability, preservation stability, and pulverization property, is not provided yet.

SUMMARY OF THE INVENTION

Accordingly, an object of the present invention is to provide a toner, preferably used for the non-magnetic one-component developing method, having a good combination of durability, fixability, preservation stability, and pulverization property.

Another object of the present invention is to provide a developing device and an image forming apparatus which can be small in size.

Another object of the present invention is to provide an image forming method which can produce high quality images for a long period of the time.

These and other objects of the present invention, either individually or in combinations thereof, as hereinafter will become more readily apparent can be attained by a toner, comprising:

a colorant;

a binder resin (A) which is a polyester resin having no tetrahydrofuran insoluble component, and having a molecular weight distribution such that components having a molecular weight of not greater than 500 are included in an amount of not greater than 4% by weight and a peak is present in a molecular weight range of from 3,000 to 9,000 when measured by gel permeation chromatography (GPC); and a binder resin (B) which is a polyester resin having no tetrahydrofuran insoluble component, and comprising units of a polycarboxylic acid and a diol having the following formula (1):

(1)

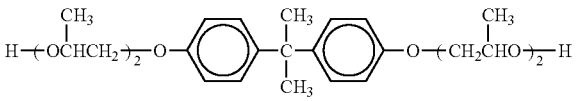

wherein at least one of the binder resins (A) and (B) is prepared in the presence of a titanium-containing catalyst having the following formulae (2) or (3):

$$Ti(—X)_m(—OH)_n \quad (2)$$

$$O{=}Ti(—X)_p(—OR)_q \quad (3)$$

wherein X represents a residue group of a mono- or poly-alkanolamine from which a hydrogen atom is removed from one hydroxyl group, wherein each of the other hydroxyl groups of the poly-alkanolamine may be subjected to an intramolecular polycondensation with a hydroxyl group directly bound to a Ti atom to which the residue group X is bound so as to form a ring structure, or an intermolecular polycondensation with a hydroxyl group directly bound to another Ti atom so as to form a repeating structure, wherein the repeating structure has a polymerization degree of from 2 to 5; R represents a hydrogen atom or an alkyl group having 1 to 8 carbon atoms which may have 1 to 3 ether bonds; m represents an integer of 1 to 4, n represents an integer of 0 to 3, wherein a sum of m and n is 4, p represents an integer of 1 or 2, q represents and integer of 0 or 1, wherein a sum of p and q is 2, and when each of m and p is 2 or more, each of the plurality of X may be same or different, and wherein a weight ratio ((A)/(B)) of the binder resin (A) to the binder resin (B) is from 60/40 to 85/15; and a developing device, an image forming apparatus, and an image forming method using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Toner (Binder Resin)

Figure 1:
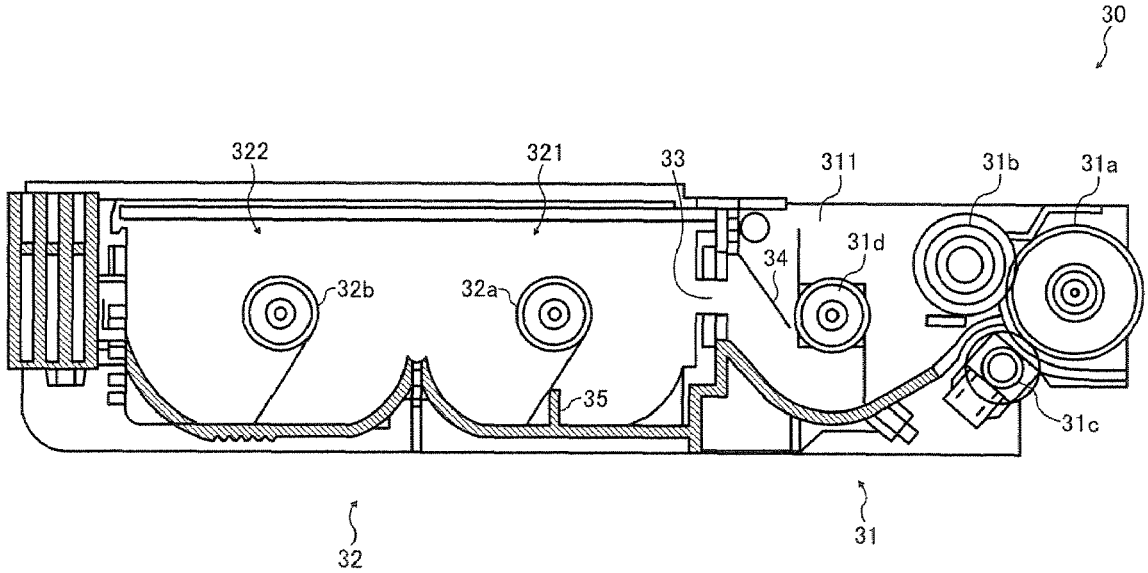
FIG. 1 is a schematic view illustrating an embodiment of the developing device of the present invention.

Generally, the present invention provides a toner comprising a colorant, a binder resin (A), and a binder resin (B).

As the binder resin (A), a polyester resin is used. Polyester resins can typically impart good color reproducibility and image strength to the resultant full-color image. Since the full-color image consists of plural toner layers and has a large thickness, cracks tend to appear on the image and the glossiness thereof tends to decrease. For these reasons, a polyester resin having an appropriate physical strength and property of producing high glossiness images is preferably used.

The polyester resin is typically prepared by an esterification reaction between a polyol and a polycarboxylic acid. Specific examples of polyols include, but are not limited to, divalent alcohols such as diols (e.g., ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol), bisphenol A, hydrogenated bisphenol A, and alkylene oxide adducts of bisphenol A (e.g., polyoxypropylene adduct of bisphenol A); and alcohols having 3 or more valences such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, and oxyalkylene ether of a novolac phenol resin. Alcohols having 3 or more valences are mainly used as a cross-linking component.

Among these polyols, alkylene oxide adducts of bisphenol A are preferably used. A polyester resin including bisphenol A units has relatively high glass transition temperature, and therefore the resultant toner has good copy blocking resistance and thermostable preservability. Alkylene groups present on both ends of the bisphenol A skeleton can act as soft segments in the polymer, and thereby the resultant image has good color reproducibility and image strength. In particular, ethylene group and propylene group are preferably used as an alkylene group of the alkylene oxide adduct of bisphenol A.

Specific examples of the polycarboxylic acids include, but are not limited to, divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenylsuccinic acids (e.g., n-dodecenylsuccinic acid), alkylsuccinic acids (e.g., n-dodecylsuccinic acid), and anhydrides and alkyl esters thereof; and carboxylic acids having 3 or more valences such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-methylenecarboxypropane, tetra(methylenecarboxyl)methane, 1,2,7,8-octanetetracarboxylic acid, and anhydrides, alkyl esters, alkenyl esters, and aryl esters thereof.

Specific examples of the tricarboxylic acids and alkyl, alkenyl, and aryl esters thereof include, but are not limited to, 1,2,4-benzenetricarboxylic acid, trimethyl 1,2,4-benzenetricarboxylate, triethyl 1,2,4-benzenetricarboxylate, tri-n-butyl 1,2,4-benzenetricarboxylate, triisobutyl 1,2,4-benzenetricarboxylate, tri-n-octyl 1,2,4-benzenetricarboxylate, tri-2-ethylhexyl 1,2,4-benzenetricarboxylate, tribenzyl 1,2,4-benzenetricarboxylate, and tris(4-isopropylbenzyl)1,2,4-benzenetricarboxylate.

It is known that the chargeability of a polyester resin is proportional to the acid value thereof. In other words, the higher acid value a polyester resin has, the higher negative chargeability the polyester resin has. The acid value also influences on the environmental charging stability of a polyester resin. The higher acid value a polyester resin has, the larger charge quantity under low temperature and low humidity conditions and the smaller charge quantity under high temperature and high humidity conditions the polyester resin has. In this case, the resultant images tend to have background fouling, and image density and color reproducibility thereof tend to vary depending on the environmental condition. The polyester resin for use in the present invention preferably has an acid value of not greater than 20 mgKOH/g, and more preferably not greater than 5 mgKOH/g.

In particular, the binder resin (A) of the present invention has no tetrahydrofuran (THF) insoluble component and has a molecular weight distribution such that components having a molecular weight of not greater than 500 are included in an amount of not greater than 4% by weight, and preferably from 1 to 4% by weight, and a peak is present in a molecular weight range of from 3,000 to 9,000 when measured by gel permeation chromatography (GPC). When the resin has a THF insoluble component, glossiness and transparency of the resultant image decreases, and therefore images formed on an overhead projector (OHP) sheet have poor quality. When the resin includes components having a molecular weight of not greater than 500 in an amount of not greater than 4% by weight, brittle components can be excluded from the resin, and therefore the resultant toner can be prevented from adhering to image forming members and forming a toner film thereon, and being pulverized in a developing device. A toner including such a resin can be used for the non-magnetic one-component developing method for a long period of the time because of having high durability. In view of manufacturability, the resin preferably includes components having a molecular weight of not greater than 500 in an amount of not less than 1% by weight.

The binder resin (B) is a polyester resin prepared by an esterification reaction between a polycarboxylic acid and a polyol. The polyols mentioned in the above descriptions of the binder resin (A) can be used for the binder resin (B) also. The polyol used for the binder resin (B) necessarily includes a diol having the following formula (1):

(1)

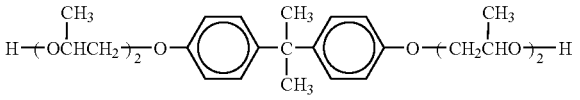

The polyol used for the binder resin (B) preferably includes the diol having the formula (1) in an amount of not less than 50% by mole, more preferably not less than 80% by mole, and much more preferably not less than 90% by mole, based on total amount of the polyol.

Other kinds of diols can be used in combination, but it is preferable that the diol having the formula (1) is used alone. Since the diol having the formula (1) has bisphenol A skeleton, a polyester resin including units of the diol having the formula (1) has relatively high glass transition temperature, and therefore the resultant toner has good copy blocking resistance and thermostable preservability. Alkylene groups present on both ends of the bisphenol A skeleton can act as soft segments in the polymer, and thereby the resultant image has good color reproducibility and image strength. In particular, ethylene oxide adduct of bisphenol A and propylene oxide adduct of bisphenol A are preferably used. Specifically, propylene oxide adduct of bisphenol A has better pulverization property without deteriorating filming resistance compared with ethylene oxide adduct of bisphenol A. The obvious reason for this is uncertain, but it is considered that methyl groups forming side chains contribute to the brittleness of the resin.

As a cross-linking component, an alcohol having 3 or more valences mentioned in the above description of the binder resin (A) can be used in combination with the diol. Among these, novolac phenol resins and ether resins thereof are preferably used to improve hot offset resistance and low-temperature fixability of the resultant toner.

An oxyalkylene ether (B1) of a novolac phenol resin is a reaction product of a novolac phenol resin (a) with a compound (b) having one epoxy ring.

Specific examples of the novolac phenol resin (a) include, but are not limited to, compounds prepared by a polycondensation reaction between a phenol and an aldehyde in the presence of a catalyst such as inorganic acids (e.g., hydrochloric acid, phosphoric acid, sulfuric acid), organic acids (e.g., p-toluene sulfonic acid, oxalic acid), and metal salts (e.g., zinc acetate).

Specific examples of the phenols include, but are not limited to, phenol and substituted phenols having 1 to 35 carbon atoms and 1 or more hydrocarbon groups and/or halogen groups. Specific examples of the substituted phenols include, but are not limited to, o-cresol, m-cresol, p-cresol, ethylphenol, nonylphenol, octylphenol, phenylphenol, styrenated phenol, isopropenylphenol, 3-chlorophenol, 3-bromophenol, 3,5-xylenol, 2,4-xylenol, 2,6-xylenol, 3,5-dichlorophenol, 2,4-dichlorophenol, 3-chloro-5-methylphenol, dichloroxylenol, dibromoxylenol, 2,4,5-trichlorophenol, and 6-phenyl-2-chlorophenol. These can be used alone or in combination. Among these, phenol and substituted phenols having a hydrocarbon group are preferably used In particular, phenol, cresol, t-butylphenol, and nonylphenol are most preferably used. Phenol and cresol are preferable in view of cost thereof and imparting hot offset resistance to the resultant toner. Substituted phenols having a hydrocarbon group such as t-butylphenol and nonylphenol are preferable in view of minimizing temperature dependence of the chargeability of the resultant toner.

The novolac phenol resin (a) typically has a number average molecular weight of from 300 to 8,000, preferably from 400 to 3,000, and more preferably from 450 to 2,000.

Specific examples of the aldehydes include, but are not limited to, formalins (i.e., aqueous solutions of formaldehyde in various concentrations), paraformaldehyde, trioxane, and hexamethylenetetramine.

The polycarboxylic acids mentioned in the above descriptions of the binder resin (A) can be used for the binder resin (B) also.

The chargeability of the polyester resin for use in the binder resin (B) is proportional to the acid value thereof as mentioned above. The polyester resin for use in the binder resin (B) preferably has an acid value of not greater than 20 mgKOH/g, and more preferably not greater than 5 mgKOH/g.

(Titanium-containing Catalyst)

At least one of the binder resins (A) and (B) is a polyester resin prepared in the presence of a specific titanium-containing catalyst. The titanium-containing catalyst for use in the present invention has the following formulae (2) or (3), and these can be used alone or in combination:

$$Ti(—X)_m(—OH)_n \quad (2)$$

$$O{=}Ti\ (—X)_p(—OR)_q \quad (3)$$

wherein X represents a residue group of a mono- or polyalkanolamine having 2 to 12 carbon atom, from which a hydrogen atom is removed from one hydroxyl group.

The titanium-containing catalyst typically includes 1 or 2, preferably 1, nitrogen atoms (i.e., total number of primary, secondary, and tertiary amino groups).

Specific examples of the monoalkanolamines include, but are not limited to, ethanolamine and propanolamine. Specific examples of the polyalkanolamines include, but are not limited to, dialkanolamines (e.g., diethanolamine, N-methyl diethanolamine, N-butyl diethanolamine), trialkanolamines (e.g., triethanolamine, tripropanolamine), and tetrapropanolamine (e.g., N,N,N',N'-tetrahydroxyethyl ethylenediamine).

In a polyalkanolamine, 1 or more hydroxyl groups are present other than a hydroxyl group from which a hydrogen atom is removed so as to bind to the Ti atom. Each of these hydroxyl groups may be subjected to an intramolecular polycondensation with a hydroxyl group directly bound to the Ti atom to which the residue group X is bound so as to form a ring structure, or an intermolecular polycondensation with a hydroxyl group directly bound to another Ti atom so as to form a repeating structure. The repeating structure typically has a polymerization degree of from 2 to 5. When the polymerization degree is not less than 6, catalytic property deteriorates. As a result, oligomers are produced and therefore blocking resistance of the resultant toner deteriorates.

As X, a residue group of a dialkanolamine (preferably diethanolamine) and a residue group of a trialkanolamine (preferably triethanolamine) are preferably used, and a residue group of triethanolamine is most preferably used.

R represents a hydrogen atom or an alkyl group having 1 to 8 carbon atoms which may have 1 to 3 ether bonds. Specific examples of the alkyl groups having 1 to 8 carbon atoms include, but are not limited to, methyl group, ethyl group, n-propyl group, isopropyl group, n-butyl group, n-hexyl group, n-octyl group, β-methoxyethyl group, and β-ethoxyethyl group. Among these, a hydrogen atom and an alkyl group having 1 to 4 carbon atoms and no ether bond are preferably used; and a hydrogen atom, ethyl group, and isopropyl group are more preferably used.

In the formula (2), m represents an integer of 1 to 4, preferably 1 to 3, and n represents an integer of 0 to 3, preferably 1 to 3, wherein the sum of m and n is 4.

In the formula (3), p represents and integer of 1 or 2 and q represents an integer of from 0 or 1, wherein the sum of p and q is 2.

When each of m and p is 2 or more, each of the plurality of X may be same or different, and preferably same.

Specific examples of the titanium-containing catalyst having the formula (2) include, but are not limited to, titanium dihydroxybis(triethanolaminato), titanium trihydroxytriethanolaminato, titanium dihydroxybis(diethanolaminato), titanium dihydroxybis(monoethanolaminato), titanium dihydroxybis(monopropanolaminato), titanium dihydroxybis(N-methyldiethanolaminato), titanium dihydroxybis(N-butyldiethanolaminato), a reaction product of tetrahydroxy titanium with N,N,N',N'-tetrahydroxyethyl ethylenediamine, and intramolecular and intermolecular polycondensation reaction products thereof.

Specific examples of the titanium-containing catalyst having the formula (3) include, but are not limited to, titanyl bis(triethanolaminato), titanyl bis(diethanolaminato), titanyl bis(monoethanolaminato), titanyl hydroxyethanolaminato, titanyl hydroxytriethanolaminato, titanyl ethoxytriethanolaminato, titanyl isopropoxytriethanolaminato, and intramolecular and intermolecular polycondensation reaction products thereof.

Among these, titanium dihydroxybis(triethanolaminato), titanium dihydroxybis(diethanolaminato), titanyl bis(triethanolaminato), polycondensation reaction products thereof, and mixtures thereof are preferably used; titanium dihydroxybis(triethanolaminato) and polycondensation reaction products thereof are more preferably used; and titanium dihydroxybis(triethanolaminato) is most preferably used.

These titanium-containing catalyst can be stably prepared by reacting a titanium dialkoxybis(alcoholaminato) (which is commercially available from Du Pont Kabushiki Kaisha etc.) at a temperature of from 70 to 90° C. in the presence of water.

(Acid Value)

The acid value (AV) can be measured under the following conditions.

Measurement device: automatic potentiometric titrator DL-53 TITRATOR (manufactured by Mettler-Toledo International Inc.)

Electrode: DG113-SC (manufactured by Mettler-Toledo International Inc.)

Analysis software: LabX Light Version 1.00.000

Device correction: using a mixed solvent of 120 ml of toluene and 30 ml of ethanol Measurement temperature: 23° C.

Measurement conditions:

| | |
|---|---|
| Stir | |
| Speed [%] | 25 |
| Time [s] | 15 |
| EQP titration | |
| Titrant/Sensor | |
| Titrant | $CH_3ONa$ |
| Concentration [mol/L] | 0.1 |
| Sensor | DG115 |
| Unit of measurement | mV |

-continued

| | |
|---|---|
| Predispensing to volume | |
| Volume [mL] | 1.0 |
| Wait time [s] | 0 |
| Titrant addition | Dynamic |
| dE (set) [mV] | 8.0 |
| dV (min) [mL] | 0.03 |
| dV (max) [mL] | 0.5 |
| Measure mode | Equilibrium controlled |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs n = 1 | Yes |
| comb. termination conditions | No |
| Evaluation | |
| Procedure | Standard |
| Potential 1 | No |
| Potential 2 | No |
| Stop for reevaluation | No |

The acid value (AV) is measured according to JIS K0070-1992 as follows:

(1) 0.5 g of a sample or 0.3 g of ethyl acetate soluble component thereof is added to 120 ml of toluene, and the mixture is agitated for about 10 hours at room temperature (23° C.);

(2) 30 ml of ethanol is further added to the mixture to prepare a sample liquid; and (3) the sample liquid is titrated with a standardized N/10 potassium hydroxide alcohol solution, using the above-mentioned titrator.

An acid value is calculated from the following equation:

$$AV=\mathrm{KOH(ml)}\times N\times 56.1/Ws$$

wherein AV represents an acid value, KOH represents the amount of the standardized potassium hydroxide alcohol solution (ml) consumed in the titration, N represents the factor of the standardized caustic potash alcohol solution, and Ws represents the weight of the sample.

(Molecular Weight Distribution)

The measurement conditions are as follows:

GPC measurement system: HLC-8220GPC (from Tosoh Corporation)

Column: TSKgel SuperHZM-H 15 cm×3

Temperature: 40° C.

Solvent: THF (tetrahydrofuran)

Flow rate: 0.35 ml/min

Sample: 0.4 ml of a sample solution having a concentration of 0.15% by weight is injected Pre-treatment of sample: a sample is dissolved in THF (including a stabilizer, from Wako Pure Chemical Industries, Ltd.) so that the solution has a concentration of 0.15% by weight, and then the solution is filtered with a 0.2 μm-filter.

The molecular weight of the sample is determined while comparing the molecular distribution curve thereof with the working curve which is previously prepared using polystyrene standard samples each having a single molecular weight peak. As the polystyrene standard samples, SHOWDEX STANDARD S-7300, S-210, S-390, S-875, S-1980, S-10.9, S-629, S-3.0, and S-0.580, and toluene are used. As a detector, a refractive index detector (RI) is used.

The weight ratio ((A)/(B)) of the binder resin (A) to the binder resin (B) is from 60/40 to 85/15, and preferably from 70/30 to 80/20. When the weight ratio is too small, filming resistance of the toner deteriorates. When the weight ratio is too large, pulverization property deteriorates.

It is preferable that the main peak molecular weight (MB) of the binder resin (B) when measured by GPC is larger than that (MA) of the binder resin (A). Since the binder resin (B) has poor filming resistance while having good pulverization property, the molecular weight thereof is preferably as large as possible. In contrast, since the binder resin (A) has good filming resistance, the molecular weight thereof can be relatively small. The main peak molecular weight (MB) of the binder resin (B) is preferably from 1.1 to 2.0 times, and more preferably from 1.15 to 1.7 times, that (MA) of the binder resin (A).

(Solubility Parameter)

The constituents of the binder resins (A) and (B) are preferably different from each other in view of compatibilities therebetween and between other toner components (e.g., colorant, charge controlling agent). The solubility parameter is typically used as an index of compatibility of a resin, etc. The solubility parameters of the binder resins (A) and (B) are preferably different from each other to a certain degree. When the solubility parameter difference therebetween is too large, the binder resin (A) has poor compatibility with the binder resin (B), and therefore each of the resins are localized in the resultant toner. The binder resin (B), which has good pulverization property, tends to be present at the surface portion of the toner, resulting in deterioration of filming resistance. In contrast, when the solubility parameter difference therebetween is too small, the binder resins (A) has good compatibility with the binder resin (B), but the binder resins (A) and (B) have poor compatibility with other toner components such as a colorant and charge controlling agent. As a result, the colorant and the charge controlling agent are not well dispersed in the resultant toner, and therefore image density and transparency of the resultant image deteriorate and filming and deterioration of charge quantity tend to be caused. The solubility parameter difference between the binder resins (A) and (B) is preferably from 0.2 to 1.0.

The solubility parameter (δ) can be calculated from the following equation, for example:

$$\delta=(\Delta E/V)^{1/2}$$

wherein δ represents a solubility parameter, ΔE represents an intermolecular cohesive energy (i.e., heat of vaporization), V represents a volume of a mixture liquid, and ΔE/V represents a cohesive energy density.

A change in heat quantity (ΔHm) which is observed when 2 components are mixed can be calculated from the following equation using the solubility parameter (δ):

$$\Delta Hm=V(\delta 1-\delta 2)\cdot(\Phi 1/\Phi 2)$$

wherein ΔHm represents a change in heat quantity, V represents a volume of a mixture liquid, δ1 represents a solubility parameter of a solvent, δ2 represents a solubility parameter of a solute, Φ1 represents a volume fraction of the solvent, and Φ2 represents a volume fraction of the solute.

The closer value δ1 and δ2 have (i.e., the smaller value (δ1-δ2) has), the smaller value ΔHm has, and therefore Gibbs free energy is small. In other words, when the difference in solubility parameter between 2 components is small, there is high affinity therebetween.

A solubility parameter (δ) of an unknown resin can be actually determined by comparing solubilities between various solvents of which the solubility parameters are already known. In particular, the solubility parameter of the solvent in which the unknown resin is most soluble is considered as that of the unknown resin.

As another example of the calculating method of the solubility parameter, Fedor's method is known. This method can be used when the monomer composition of a resin is already known. The equation is:

$$\delta=(\Sigma\Delta ei/\Sigma\Delta vi)^{1/2}$$

wherein δ represents a solubility parameter, Δei represents an evaporation energy of an atom or an atom group, and Δvi represents a molecular volume of an atom or an atom group.

In the present invention, solubility parameters are calculated from the monomer composition.

(Charge Controlling Agent)

The toner of the present invention can include a charge controlling agent. Any known charge controlling agent can be used, and 1 or more of them can be used in combination. Specific examples of the charge controlling agents include, but are not limited to, Nigrosine dyes, triphenylmethane dyes, metal complex dyes including chromium, chelate compounds of molybdic acid, Rhodamine dyes, alkoxyamines, quaternary ammonium salts fluorine-modified quaternary ammonium salts, alkylamides, phosphor and compounds including phosphor, tungsten and compounds including tungsten, metal salts of salicylic acid derivatives, and fluorine-containing activators.

However, salts of heavy metals (e.g., nickel, copper, zinc, mercury, chromium) are not preferably used in terms of safety, transparency of the resultant toner, and compatibility with a binder resin. In the non-magnetic one-component developing method, a toner tends to accumulate on the developing sleeve and a shear is applied thereto, especially when an image having low image proportion is developed. In this case, a heavy metal salt tends to release from the toner because these are less compatible with each other. For this reason, polymeric charge controlling agents (hereinafter referred to as charge controlling resin) are preferably used.

As the charge controlling resin, a negative charge controlling resin including units of a monomer having a sulfonate group, an aromatic monomer having an electron-accepting group, and an acrylate or methacrylate monomer. Specific examples of the monomers having a sulfonate group include, but are not limited to, monomers having an aromatic sulfonate group and monomers having an aliphatic sulfonate group. Specific examples of the monomers having an aromatic sulfonate group include, but are not limited to, alkali metal salts, alkaline earth metal salts, amine salts, and quaternary ammonium salts of styrenesulfonic acid, sulfophenyl acrylamide, sulfophenyl maleimide, and sulfophenyl itaconimide. Specific examples of the monomers having an aliphatic sulfonate group include, but are not limited to, alkali metal salts, alkaline earth metal salts, amine salts, and quaternary ammonium salts of vinyl sulfonic acid, allylvinyl sulfonic acid, 2-acrylamide-2-methylpropanesulfonic acid, and methacryloyloxyethyl sulfonic acid.

Specific examples of the aromatic monomers having an electron-accepting group include, but are not limited to, substituted styrenes (e.g., chlorostyrene, dichlorostyrene, bromostyrene, fluorostyrene, nitrostyrene, cyanostyrene), substituted phenyl(meth)acrylates (e.g., chlorophenyl(meth)acrylate, bromophenyl(meth)acrylate, nitrophenyl(meth)acrylate, chlorophenyloxyethyl(meth)acrylate), substituted phenyl(meth)acrylamides (e.g., chlorophenyl(meth)acrylamide, bromophenyl(meth)acrylamide, nitrophenyl(meth)acrylamide), substituted phenyl maleimides (e.g., chlorophenyl maleimide, dichlorophenyl maleimide, nitrophenyl maleimide, nitrochlorophenyl maleimide), substituted phenyl itaconimides (e.g., chlorophenyl itaconimide, dichlorophenyl itaconimide, nitrophenyl itaconimide, nitrochlorophenyl itaconimide), and substituted phenyl vinyl ethers (e.g., chlorophenyl vinyl ether, nitrophenyl vinyl ether). In particular, phenyl maleimides and phenyl itaconimides substituted with a chlorine atom or a nitro group are preferably used in terms of improving chargeability and filming resistance of the resultant toner.

Specific examples of the acrylate or methacrylate monomers include, but are not limited to, methyl(meth)acrylate, ethyl(meth)acrylate, propyl(meth)acrylate, n-butyl(meth)acrylate, isobutyl(meth)acrylate, stearyl(meth)acrylate, dodecyl(meth)acrylate, and 2-ethylhexyl(meth)acrylate.

The monomer having a sulfonate group improves negatively charging property of the resultant charge controlling resin, while decreasing environmental resistance (i.e., temperature and humidity stability) thereof due to high hygroscopic property. In order to solve this problem, a method in which the aromatic monomer having an electron-accepting group is used in combination to prepare a copolymer thereof is generally known. However, a toner including such a copolymer tends to contaminate a developing sleeve, a toner layer controlling member (e.g., a blade, a roller), etc. and form a toner film on a photoreceptor after several tens of thousands of copies are produced, resulting in insufficient charging stability of the resultant toner and the resultant image quality. When a polyester resin, which is suitable for use in a full-color toner in terms of color reproducibility and image strength, is used as a binder resin, a copolymer including units of a monomer having a sulfonate group, an aromatic monomer having an electron-accepting group, and an acrylate or methacrylate monomer is preferably used in combination as a polymeric charge controlling agent. This is because such a copolymer hardly release from a toner particle, and therefore the resultant toner has good charging stability and environmental stability. In addition, the resultant toner hardly contaminates a developing sleeve, a toner layer controlling member (e.g., a blade, a roller), etc., stably forms a thin toner layer, hardly forms a toner film on a photoreceptor, and stably produces high quality images.

It is considered that the combination of the monomer having a sulfonate group and the aromatic monomer having an electron-accepting group can improve negatively charging property, and the acrylate or methacrylate monomer can improve environmental charging stability and pulverization property.

The charge controlling resin includes units of the monomer having a sulfonate group in an amount of from 1 to 30% by weight, and preferably from 2 to 20% by weight. When the amount is too small, the resultant toner has insufficient charge rising property and charge quantity, resulting in producing abnormal images. When the amount is too large, environmental charging stability of the resultant toner deteriorates, i.e., the charge quantity under high temperature and humidity conditions is low and that under low temperature and humidity conditions is high, and therefore high quality images cannot be stably produced. Further, the resultant toner tends to contaminate a developing sleeve, a toner layer controlling member (e.g., a blade, a roller), etc. and form a toner film on a photoreceptor. There is also a drawback that the resultant toner has poor productivity when manufactured by a kneading-pulverization method.

The charge controlling resin includes units of the aromatic monomer having an electron-accepting group in an amount of from 1 to 80% by weight, and preferably from 20 to 70% by weight. When the amount is too small, the resultant toner has too small a charge quantity, resulting in the occurrence of background fouling and toner scattering. When the amount is too large, the resultant copolymer has poor dispersibility in the toner, resulting in the occurrence of background fouling and toner scattering due to the broad charge quantity distribution thereof.

The charge controlling resin includes units of the acrylate or methacrylate monomer in an amount of from 10 to 80% by weight, and preferably from 20 to 70% by weight. When the amount is too small, the resultant toner has poor environmental charging stability and pulverization property when manufactured by a kneading-pulverization method, and tends to contaminate a developing sleeve, a toner layer controlling member (e.g., a blade, a roller), etc., and form a toner film on a photoreceptor. When the amount is too large, the resultant toner has insufficient charge rising property and charge quantity, resulting in producing abnormal images.

When the above-mentioned charge controlling resin is used in combination with a polyester resin, which is suitable for use in a full-color toner in terms of color reproducibility and image strength, the charge controlling resin has good dispersibility in the toner and the toner has sharp charge quantity distribution.

The toner of the present invention preferably includes the charge controlling agent in an amount of from 0.1 to 20% by weight, more preferably 0.5 to 10% by weight, and much more preferably from 1.0 to 5% by weight. When the amount is too small, the resultant toner has insufficient charge rising property and charge quantity, resulting in the occurrence of background fouling and toner scattering. When the amount is too large, the charge controlling agent has poor dispersibility in the toner and thereby charge quantity distribution of the toner deteriorates. As a result, background fouling and toner scattering tend to occur.

(Colorant)

Any known dyes and pigments can be used as the colorant of the toner of the present invention.

Specific examples of black colorants include, but are not limited to, carbon black, Nigrosine dyes, and black iron oxide.

Specific examples of yellow colorants include, but are not limited to, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, and isoindolinone yellow.

Specific examples of magenta colorants include, but are not limited to, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, and Oil Orange.

Specific examples of cyan colorants include, but are not limited to, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome green, zinc green, chromium oxide, viridian, emerald green, Pigment Green B, Naphthol Green B, Green Gold, Acid Green Lake, Malachite Green Lake, Phthalocyanine Green, and Anthraquinone Green.

Specific examples of other colorants include, but are not limited to, titanium oxide, zinc oxide, and lithopone.

These can be used alone or in combination. The toner preferably includes a colorant in an amount of from 0.1 to 50 parts by weight, based on 100 parts by weight of a binder resin.

A colorant can be previously treated with a binder resin so as to improve dispersibility in the binder resin. Thereby, the resultant toner can have a good combination of coloring power even if the content of the colorant is small, transparency, color reproducibility, and chargeability. Specifically, a mixture of a colorant and a binder resin is melt-kneaded and then coarse-pulverized. The mixture preferably includes the binder resin in an amount of from 1 to 5 parts by weight based on 1 part by weight of the colorant. When the amount of the binder resin is too small, the colorant cannot be sufficiently dispersed in the binder resin. When the amount of the binder resin is too large, the binder resin cannot give sufficient dispersion force to the colorant, resulting in poor dispersibility thereof. When 2 or more colorants are used in combination, each of the colorant may be independently subjected to the treatment, or the mixture thereof subjected to the treatment.

(Wax)

The toner of the present invention preferably includes a wax so as to impart releasability to the toner. The wax preferably has a melting point of from 40 to 120° C., and more preferably from 50 to 110° C. When the melting point is too large, low-temperature fixability of the resultant toner deteriorates. When the melting point is too small, hot offset resistance and durability of the resultant toner deteriorates. The melting point of the wax can be determined by differential scanning calorimetry (DSC) In particular, a peak observed when a sample is heated at a temperature rising rate of 10° C./min is defined as the melting point.

Specific examples of the waxes include, but are not limited to, paraffin waxes, micro waxes, rice waxes, fatty acid amide waxes, fatty acid waxes, aliphatic monoketones, metal salts of fatty acids, fatty acid ester waxes, partially-saponified fatty acid ester waxes, silicone varnishes, higher alcohols, and carnauba waxes. In addition, polyolefins such as low-molecular-weight polyethylenes and polypropylenes can also be used. In particular, polyolefins having a softening point measured by Ring and Ball method of from 70 to 150° C., preferably from 120 to 150° C., are preferably used.

(Cleanability Improving Agent)

A cleanability improving agent can be added to the toner so as to remove toner particles remaining on the surface of a photoreceptor or a primary transfer medium after a toner image is transferred. Specific examples of the cleanability improving agents include, but are not limited to, metal salts of fatty acids such as zinc stearate and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.1 μm to 1 μm are preferably used as the cleanability improving agent.

(External Additive)

The toner may be mixed with a particulate inorganic material (i.e., external additive) such as a metal oxide so as to improve fluidity and chargeability of the toner. The surface of the particulate inorganic material can be optionally treated with a silane coupling agent, titanate coupling agent, a silicone oil, an organic acid, etc., or covered with a specific resin, so as to improve hydrophobicity and chargeability thereof. Specific examples of the particulate inorganic materials include, but are not limited to, silicon dioxide (silica), titanium dioxide (titania), aluminum oxide, zinc oxide, magnesium oxide, cerium oxide, iron oxide, copper oxide, and tin oxide. In particular, a hydrophobized silica in which silanol groups present on the surface of a silica are substituted with organic acid groups, prepared by reacting the silica and an organic silicon compounds such as dimethyldichlorosilane, hexamethyldisilazane, and a silicone oil, is preferably used.

The toner preferably includes 2 or more external additives having different particle diameters. One of the external additives preferably has a particle diameter 2 to 5 times that of the other. When the toner includes only one external additive, the external additive tends to be buried in the mother toner with time, resulting in deterioration of fluidity of the toner. A toner having poor fluidity tends to cause image unevenness. In this case, the external additive weakly adheres to the toner and easily releases therefrom, resulting in making flaws on a photoreceptor and causing image defect. When the toner includes 2 or more external additives having different particle diameter, the smaller external additive which improves fluidity of the toner is prevented from being buried in the mother toner, because the larger external additive acts like a spacer. Therefore, fluidity of the toner can be maintained.

The larger external additive preferably has a BET specific surface area of from 30 to 80 $m^2/g$, and more preferably from 40 to 60 $m^2/g$. The larger external additive can be surface-treated. When the BET specific surface area is too small, fluidity of the toner deteriorates, and therefore image unevenness tend to occur. In this case, the external additive weakly adheres to the toner and easily releases therefrom, resulting in making flaws on a photoreceptor and causing image defect. The toner preferably includes the larger external additive in an amount of from 0.1 to 5.0 parts by weight, and more preferably from 0.8 to 2.0 parts by weight, based on 100 parts by weight of the toner. When the amount is too small, transferability of the toner deteriorates. When the amount is too large, the external additive easily releases from the toner, resulting in making flaws on a photoreceptor and causing image defect.

The smaller external additive preferably has a BET specific surface area of from 100 to 250 $m^2/g$, and more preferably from 120 to 200 $m^2/g$. The smaller external additive can be surface-treated. The smaller external additive can reduce adherence of the toner. The toner preferably includes the smaller external additive in an amount of from 0.3 to 3.0 parts by weight, and more preferably from 0.5 to 1.5 parts by weight, based on 100 parts by weight of the toner. When the amount is too small, the external additive cannot exert its effect. When the amount is too large, a large amount of the external additive releases from the toner, resulting in making flaws on a photoreceptor.

The BET specific surface area ($m^2/g$) can be measured using a measuring instrument such as MACSORB® model 1201 (manufactured by Mountech Co., Ltd.), by a single point method using a liquid nitrogen. At first, a cell (which is well washed and dried) is filled with ½ full of a sample, and then the sample weight A (g) thereof is measured. Next, the cell is set in a measuring instrument, and then dried and deaerated under dried nitrogen flow at 50° C. for more than 1 hour. The cell is then cooled to room temperature, and a measurement gas (first grade 30% $N_2$—He, flow rate: 25 ml/min) is flowed therein while charging liquid nitrogen. An adsorbed volume V ($cm^3$) of the gas is measured, and then a surface area S ($m^2$) is calculated from the following equation:

$$S=K\cdot(1-P/P_0)\cdot V$$

wherein S represents a surface area S ($m^2$), K represents the gas constant 4.29, $P/P_0$ represents a relative pressure of the adsorbed gas (i.e., 0.97), and V represents the adsorbed volume ($cm^3$) of the gas.

A BET specific surface area ($m^2/g$) is obtained by dividing the surface area S ($m^2$) by the sample weight A (g).

(Magnetic Material)

The toner of the present invention can include a magnetic material to be used as a magnetic toner. Specific examples of the magnetic materials include, but are not limited to, iron oxides (e.g., magnetite, ferrite, hematite), metals (e.g., iron, cobalt, nickel), and alloys and mixtures of the above metals and aluminum, cobalt, copper, lead, magnesium, tin, zinc, antimony, beryllium, bismuth, calcium, cadmium, manganese, selenium, titanium, tungsten, vanadium, etc. The magnetic material preferably has a volume average particle diameter of from 0.1 to 2 μm. The toner preferably includes the magnetic material in an amount of from 5 to 150 parts by weight, based on 100 parts by weight of the binder resin.

(Two-component Developer)

The toner of the present invention can be mixed with a carrier to be used as a two-component developer. Specific examples of the carriers include, but are not limited to, iron powder, ferrite, magnetite, and glass beads. These carriers can be covered with a resin. Specific examples of the resins for covering the carrier include, but are not limited to, polyfluorocarbons, polyvinyl chlorides, polyvinylidene chlorides, phenol resins, polyvinyl acetals, acrylic resins, and silicone resins. Among these, silicone resins are preferably used in terms of improving the life of the carrier. The resin layer can optionally include a particulate conductive material. Specific examples of the particulate conductive materials include, but are not limited to, metal powders, carbon black, titanium oxide, tin oxide, and zinc oxide. The particulate conductive material preferably has an average particle diameter of not greater than 1 μm. When the average particle diameter is too large, it is difficult to control electric resistance of the carrier. The two-component developer preferably includes a toner in an amount of from 0.5 to 20 parts by weight, based on 100 parts by weight of a carrier.

(Particle Diameter)

The volume average particle diameter (Dv), number average particle diameter (Dn), and particle diameter distribution of a toner can be measured using an instrument COULTER COUNTER TA-II or COULETR MULTISIZER II from Coulter Electrons Inc.

The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dn) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

(Toner Manufacturing Method)

The toner of the present invention can be prepared by any known toner manufacturing method.

For example, a typical pulverization method includes the following steps:

mechanically mixing toner constituents comprising a binder resin and a colorant, to prepare a toner constituent mixture (i.e., mixing process);

melt-kneading the toner constituent mixture to prepare a kneaded mixture (i.e., melt-kneading process);

cooling and pulverizing the kneaded mixture to prepare a pulverized mixture (i.e., pulverization process); and classifying the pulverized mixture to prepare a toner (i.e. classification process).

When undesired particles are produced in the pulverization and the classification processes, these particles can be recycled in the mixing and melt-kneading process. The undesired particles are fine coarse particles which cannot be included in the product. In this case, 1 to 20 parts by weight of the undesired particles are preferably mixed with 100 parts by weight of raw materials in the mixing process or melt-kneading process.

In the melt-kneading process, the toner constituent mixture is melt-kneaded using a kneader. Specific examples of the kneaders include, but are not limited to, single-axis or double-axis continuous kneaders and batch kneaders using a roll mill. Specific examples of commercially available kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KOKNEADER from Buss Corporation, etc. The melt-kneading process should be performed such that the molecular chain of the binder resin is not cut. In particular, the melt-kneading temperature should be determined considering the softening point of the binder resin. When the melt-kneading temperature is too lower than the softening point of the binder resin, the molecular chain is cut. When the melt-kneading temperature is too higher than the softening point of the binder resin, toner constituents cannot be well dispersed.

In the pulverization process, the kneaded mixture is pulverized. The kneaded mixture is preferably subjected to coarse pulverization at first, followed by fine pulverization. Suitable pulverization methods include a method in which the particles collide with a collision board in a jet stream; a method in which the particles collide with each other in a jet mill; and the particles are pulverized in a narrow gap formed between a mechanically rotating rotor and a stator; etc.

The pulverized particles are classified in an air using centrifugal force, to prepare a toner having a desired particle diameter, for example, a toner having an average particle diameter of from 5 to 20 μm.

The above-prepared toner can be mixed with a particulate inorganic material (hereinafter referred to as external additive) such as a hydrophobized silica to improve fluidity, preservability, developability, and transferability, as mentioned above. Suitable mixers for use in mixing the toner particles and an external additive include any known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used.

Specific examples of the mixers include V-form mixers, locking mixers, Loedge Mixers, NAUTER MIXERS, HENSCHEL MIXERS and the like mixers. The thus prepared mixed particles are passed through a sieve having an opening not less than 250 mesh to remove coarse particles and aggregated particles.

Developing Device

The toner of the present invention is preferably used for a non-magnetic one-component developing device as illustrated in FIG. 1.

FIG. 1 is a schematic view illustrating an embodiment of the developing device of the present invention.

A developing device 30 includes a developing unit 31 configured to develop an electrostatic image formed on a photoreceptor serving as an image bearing member with a toner serving as a developer, and a toner cartridge 32 configured to supply a toner to the developing unit 31.

The developing unit 31 faces the photoreceptor at a developing region, and includes a developing sleeve 31*a* configured to transport the toner to the developing region, a toner supply roller 31*b* configured to supply the toner to the developing sleeve 31*a*, a toner layer thickness control roller 31*c* (serving as a toner layer thickness control member) configured to control the thickness of the toner layer on the developing sleeve 31*a*, and a first transport paddle 31*d* serving as a rotation device configured to transport the toner. The developing unit 31 further includes a developing hopper 311 configured to store the toner supplied from the toner cartridge 32.

The toner cartridge 32 includes a first toner storage room 321 and a second toner storage room 322 configured to store the toner, a second transport paddle 32*a* and a third transport paddle 32*b* serving as agitators configured to transport the toner to the developing unit 31, and a rib 35 serving as a projection arranged on the inner bottom surface of the first toner storage room 321 of the toner cartridge 32 at a portion in which the second transport paddle 32*a* rotates.

In the developing device 30, the developing unit 31 and the toner cartridge 32 are arranged in line on the horizontal direction. One or more openings 33 are formed between the developing device 31 and the toner cartridge 32 to transport the toner therebetween. A control valve 34 is arranged so as to face the openings 33 on the side of the developing unit 31.

In the developing device 30, the toner passes through the openings 33. Thereby, a toner of a same amount as that of a toner consumed in the developing unit 31 is transported from the toner cartridge 32 to the developing unit 31 through the openings 33 to replenish the toner, and the toner in the developing unit 31, which is deteriorated because of being repeatedly used, is returned and discharged (hereinafter referred to as discharged) from the developing unit 31 to the toner cartridge 32 to be mixed with a fresh toner. The toner cartridge 32 can be replaced with a new one independently of the developing unit 31.

A one-component developer is used in the developing device 30. One-component developers have an advantage over two-component developers in terms of replacing the toner. In other words, when a two-component developer is used, it is hard to replace the toner in the two-component developer with a fresh toner. In contrast, when a one-component developer is used, it is easy to replace the developer with a fresh developer because the developer in the toner cartridge 32 is same as that in the developing unit 31. Therefore, a one-component developer is used in the developing device 30 of the present invention. In particular, a non-magnetic one-component developer is preferably used. In non-magnetic one-component developers, chargeability and fluidity of the developers (i.e., toners) are largely influenced by conditions of external additives present on the surface of the developers. In contrast, in magnetic one-component developers, developability of the developers is influenced by a magnetic force depending on the amount of a magnetic material included therein. By using a non-magnetic one-component developer for the developing device 30 of the present invention, the developer can maintain good developability for a long period of time because the external additive present on the surface of the developer can be maintained without problems such as releasing and embedding of the external additives.

The toner from the developing unit 31 is under a pressure from the toner supply roller 31*b* and the toner layer thickness control roller 31*c*. Thereby, concavities and convexities formed on the surface of the toner are smoothened, and therefore an adhesiveness of the toner to the photoreceptor increases. Such toner, however, is more difficult to clean. In other words, such toner remaining on the photoreceptor is more difficult to be removed therefrom. Especially under low humidity, such toner may not be sufficiently removed from the photoreceptor. On the other hand, such toner has high transferability. For these reasons, images produced by such toner may have fog in an image background. Typically, fog is hardly visually observed even if a toner is transferred on an image background.

In addition, external additive particles present on the surface of toner particles tend to be embedded therein by receiving a pressure, because the external additive is typically harder than the toner. As the amount of the external additive particles present on the surface of the toner particles decreases, chargeability of the toner changes. In particular, silica, for use as an external additive, has high charge quantity because of having a large specific surface area. Therefore, as the amount of the silica present on the surface of the toner particles decreases, chargeability of the toner largely changes.

Moreover, fluidity of the toner decreases as the external additive particles are embedded in the toner particles. The fluidity represents adhesiveness of the toner. For example, the external additive can decrease an adhesiveness between the toner and the photoreceptor by existing therebetween. Similarly, the external additive can decrease an adhesiveness between the toner and the developing sleeve 31 by existing therebetween, resulting in improvement of developability of the toner. As the amount of the external additive particles present on the surface of the toner particles decreases, developability of the toner decreases.

In the non-magnetic one-component developing device, toner particles having a smaller particle diameter are preferentially supplied onto the developing sleeve 31*a* by the toner supply roller 31*b* (i.e., selective development). Thereby, deteriorated coarse toner particles remain in the developing hopper 311 unless the fresh toner is supplied from the toner cartridge 32, resulting in deterioration of the resultant images and occurrence of toner scattering.

In the developing device 30 of the present invention, toner particles remaining in the developing unit 31 are at once returned and discharged to the toner cartridge 32 through the openings 33. Thereby, the toner particles in the developing unit 31 are mixed with fresh toner particles in the toner cartridge 32 to decrease the content of deteriorated toner particles, and then the thus mixed toner particles are transported to the developing unit 31 again through the openings 33.

Figure 2A:
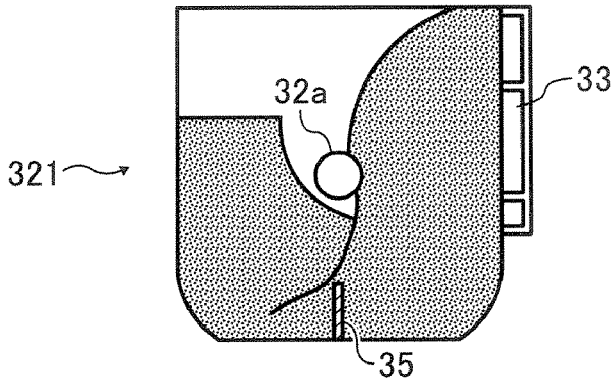
FIGS. 2A to 2C are schematic views for explaining how the toner in the toner cartridge is agitated and transported by a rotation member.
Figure 2B:
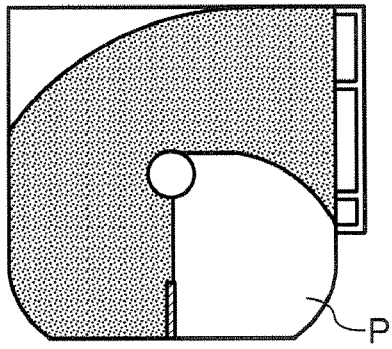
Figure 2C:
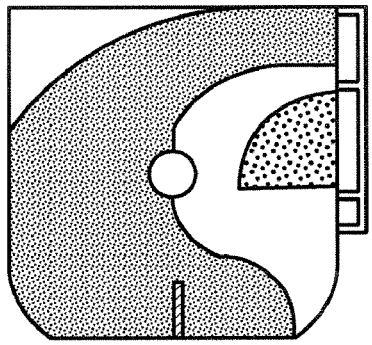

FIGS. 2A-2C are schematic views for explaining how the toner particles in the toner cartridge 32 are moved by the second transport paddle 32*a*. Referring to FIG. 1, in the toner cartridge 32, the third transport paddle 32*b* in the second toner storage room 322 transports toner particles to the first toner storage room 321. The second transport paddle 32*a* transports the thus transported toner particles toward the developing unit 31. The second transport paddle 32*a* includes one paddle film having elasticity (i.e., a bendable film). The toner particles in the first toner storage room 321 are fed toward the developing unit 31 by rotating the paddle film of the second transport paddle 32*a*. In addition, the rib 35 is arranged on the inner bottom surface of the first toner storage room 321. When the paddle film of the second transport paddle 32*a* is located at such a position as to be contacted with the rib 35 and then is released from the rib 35 while bending as illustrated in FIG. 2A to FIG. 2B, a space P is formed between the paddle film and the rib 35 on the downstream side from the paddle film relative to the rotation direction thereof. The space P is gradually filled with a toner having high fluidity, however, the space is maintained for a while.

When a timing such that the paddle film pushes the toner particles into the developing unit 31 corresponds with a timing such that the control valve 34 of the developing unit 31 is opened and not pressed by the paddle film of the first transport paddle 31*d* (i.e., the control valve is in a home position), the toner particles are supplied from the toner cartridge 32 to the developing unit 31 through the openings 33.

When the control valve 34 is opened, toner particles come into an area below the control valve 34. When a timing such that (1) the paddle film of the first transport paddle 31*d* presses the control valve 34 to push the toner particles present below the control valve 34 into the toner cartridge 32 from the developing unit 31 corresponds with a timing such that (2) the space P formed by the paddle film of the second transport paddle 32*a* in the first toner storage room 321 is located in the vicinity of the openings 33, the toner particles in the developing unit 31 are discharged to the toner cartridge 32 through the openings 33.

The space P gradually reduces its volume by being filled with a toner having high fluidity. In order that the space P maintains a sufficient volume for a while and toner particles are smoothly discharged to the toner cartridge 32, the toner preferably has a moderate fluidity. As an indicator of the fluidity of a toner, the collapse angle is known. The toner of the present invention preferably has a collapse angle of from 30 to 70°.

(Collapse Angle)

The collapse angle can be measured as follows.

At first, 10 g of a toner is contained in a cylindrical glass container having a diameter of 3 cm and a height of 7 cm and a lid is put thereon. The glass container is set to a shaker Model-YS-8D (from Yayoi Co., Ltd.) and shaken for 1 minute at a stroke width of 80 mm and a stroke number of 100 times/min. By the above operation, the toner is given a certain amount of fluidity. Next, attachments for measuring an angle of repose are set to an instrument POWDER TESTER PT-N (from Hosokawa Micron Corporation), and then a glass tube having a diameter of 3 cm and a height of 5 cm is put thereon. The above-prepared toner is poured into the glass tube and left at rest for 1 minute. The glass tube is vertically pulled up so as to separate from the toner. Thereby, a conical pile of the toner is formed on a horizontal surface. The collapse angle is defined as an angle formed between the surface of the pile and the horizontal surface.

The collapse angle represents the ease with which the toner pile can collapse. The collapse angle can be automatically measured by setting a measuring arm for measuring the angle of repose to the position of the angle formed between the surface of the pile and the horizontal surface.

As mentioned above, by using a toner having a moderate fluidity, the space P formed between the paddle film of the second transport paddle 32*a* and the rib 35 can be maintained in a sufficient volume, and therefore toner particles can be smoothly discharged to the toner cartridge 32. When the collapse angle is too small, the toner has too high fluidity, and therefore the space P cannot maintain its volume in the toner cartridge. In contrast, when the collapse angle is too large, the toner has too low fluidity, and therefore the toner cannot be stably developed.

(Cohesiveness)

The toner of the present invention preferably has a cohesiveness of from 6 to 15%. The cohesiveness represents a cohesive property of a powder. As the smaller cohesiveness a powder has, the smaller occurrence that the powder coheres. The cohesiveness typically has a relationship with the fluidity. The smaller cohesiveness a powder has, the higher fluidity the power has. When the cohesiveness is too small, the toner has too high fluidity, and therefore the space P cannot maintain its volume in the toner cartridge. In contrast, when the cohesiveness is too large, the toner has too low fluidity, and therefore the toner cannot be stably developed.

The cohesiveness can be measured using a vibration sieve of an instrument POWDER TESTER PT-N (from Hosokawa Micron Corporation). At first, a 400-mesh sieve, a 200-mesh sieve, and a 100-mesh sieve are laid in this order and set to a shaking table. Next, 2 g of a toner is calmly put on the sieves, and subjected to a vibration for 10 seconds. Toner particles remaining on each of the sieves are weighed. The cohesiveness is calculated from the following equation:

$$C=((W_{400}\times 0.2)+(W_{200}\times 0.6)+W_{100})/W_0\times 100$$

wherein C (%) represents a cohesiveness of a toner, $W_{400}$ (g) represents a weight of toner particles remaining on the 400-mesh sieve, $W_{200}$ (g) represents a weight of toner particles remaining on the 200-mesh sieve, $W_{100}$ (g) represents a weight of toner particles remaining on the 100-mesh sieve, and $W_0$ (g) represents a weight of the toner initially put on the sieves.

(Aerated Bulk Density)

The toner of the present invention preferably has an aerated bulk density of from 0.38 to 0.43. The aerated bulk density represents a density of sieved toner particles as it stands, and is one of an indicator of the fluidity. The aerated bulk density can be measured using an instrument POWDER TESTER PT-N (from Hosokawa Micron Corporation). A sieve having openings of 246 μm is set to a shaking table, and then 250 cc of a sample is put thereon and subjected to a vibration for 30 seconds. Sieved toner particles are contained in a 100 cc cup, and leveled off using a blade and weighed. The above operation is repeated 5 times, and the average weight of the sieved toner particles is calculated. The aerated bulk density is calculated from the following equation:

$$D=W/V$$

wherein D represents an aerated bulk density, W (g) represents an average weight of toner particles contained in a cup, and V (cc) represents a volume of the cup.

Image Forming Apparatus

Figure 3:
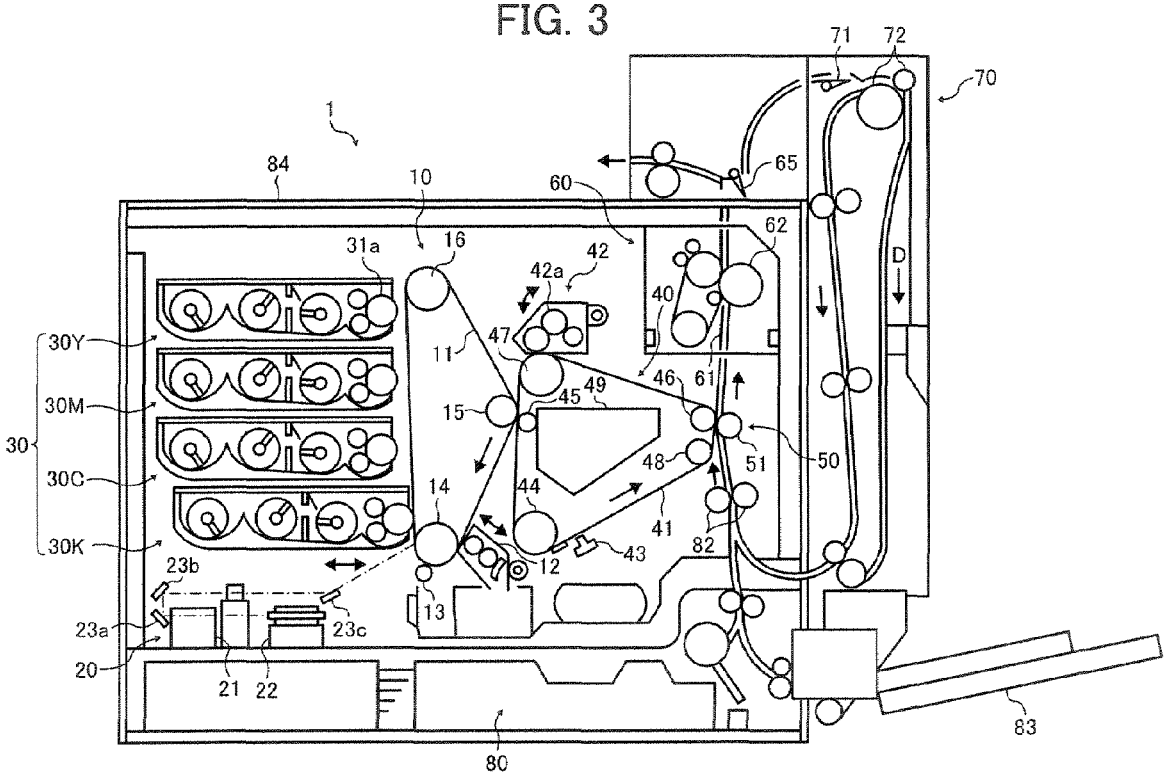
FIG. 3 is a schematic view illustrating an embodiment of the image forming apparatus of the present invention.

FIG. 3 is a schematic view illustrating an embodiment of the image forming apparatus of the present invention.

An image forming apparatus 1 includes a photoreceptor unit 10, a writing optical unit 20, a developing unit 30 including developing devices 30K, 30C, 30M and 30Y (having the same configuration as the developing device illustrated in FIG. 1), an intermediate transfer unit 40, a secondary transfer unit 50, a fixing unit 60, a duplex printing paper reversing unit 70, a paper cassette 80, and other elements discussed below. A black toner image, a cyan toner image, a magenta toner image, and a yellow toner image are formed one by one on a photoreceptor belt 11 of the photoreceptor unit 10, and these images are finally superimposed so as to produce a full color image. Around the photoreceptor belt 11, a photoreceptor cleaning device 12, a charging roller 13, the developing devices 30Y, 30M, 30C and 30K, and an intermediate transfer belt 41 of the intermediate transfer unit 40 are arranged. The photoreceptor belt 11 is stretched by a driving roller 14, a primary transfer facing roller 15, and a stretching roller 16, and is rotated by a driving motor (not shown). The writing optical unit 20 converts color image data into optical signals, and performs writing based on color information, resulting in formation of an electrostatic latent image on the photoreceptor belt 11. The writing optical unit 20 includes a semiconductor laser 21 serving as a light source, a polygon mirror 22, and reflective mirrors 23*a*, 23*b*, and 23*c*.

A black developing device 30K containing a black toner, a cyan developing device 30C containing a cyan toner, a magenta developing device 30M containing a magenta toner, and a yellow developing device 30Y containing a yellow toner, are arranged in the image forming apparatus 1 in this order from the lower side thereof. Further, an attach/detach mechanism (not shown) configured to move each of the developing devices 30K-30Y toward or away from the developing belt 11 is arranged in the image forming apparatus 1.

The toner contained in each of the developing devices 30 (symbols K, C, M and Y representing each of the colors are omitted) is charged to a predetermined polarity. A developing bias is applied to the developing sleeve 31*a* by a developing bias electric source. Therefore, the developing sleeve 31*a* is biased to a predetermined potential against the photoreceptor belt 11. When an electromagnetic clutch configured to transmit a driving force from a motor to the developing device 30 is turned on, the attach/detach mechanism moves the developing device 30 toward the developing belt 11 due to the driving force transmitted from the motor. In a developing process, one of the developing devices moves to contact the photoreceptor belt 11. In contrast, when the electromagnetic clutch is turned off so as not to transmit the driving force, the developing device 30 moves away from the photoreceptor belt 11.

When the image forming apparatus 1 is on standby, the developing devices 30K, 30C, 30M and 30Y are set apart from the photoreceptor belt 11. When an image forming operation starts, the photoreceptor belt 11 is irradiated by a laser light based on color image data so as to form an electrostatic latent image thereon. To develop a black electrostatic latent image from the tip thereof, the developing sleeve 31*a* of the black developing device 30K rotates before the tip of the black electrostatic latent image comes into a black developing region, and the black electrostatic latent image is developed with a black toner. Such a developing operation is continued in the black developing region. When the rear end of the black electrostatic latent image passes through the black developing region, the black developing device 30K moves away from the photoreceptor belt 11. And then the developing device of the next color moves and contacts the photoreceptor belt 11 to prepare for a next developing operation, before the tip of an electrostatic latent image of the next color comes into a developing area for developing the next color image.

The intermediate transfer unit 40 includes the intermediate transfer belt 41, a belt cleaning device 42, and a position detection sensor 43. The intermediate transfer belt 41 is stretched by a driving roller 44, a primary transfer roller 45, a secondary transfer facing roller 46, a cleaning facing roller 47, and a tension roller 48, and is rotated by a driving motor (not shown). Plural position detection marks are formed on the edge portions of the intermediate transfer belt 41 at which images are not formed. When one of these marks is detected by the position detection sensor 43, the image forming operation starts. The belt cleaning device 42 includes a cleaning brush 42*a* and an attach/detach mechanism (not shown) configured to move the cleaning device 42. While transferring each of the color toner images onto the intermediate transfer belt 41, the cleaning belt 42*a* moves away from the intermediate transfer belt 41 by the attach/detach mechanism.

The secondary transfer unit 50 includes a secondary transfer roller 51 and an attach/detach mechanism (not shown) including a clutch configured to move the secondary transfer roller 51 toward and away from the intermediate transfer belt 41. The secondary transfer roller 51 oscillates around the rotation center of the attach/detach mechanism according to a timing a transfer paper comes into a transfer region. The transfer paper is in contact with the intermediate transfer belt 41 upon application of a predetermined pressure applied by the secondary transfer roller 51 and the secondary transfer facing roller 46. The secondary transfer roller 51 is accurately arranged in parallel with the secondary transfer facing roller 46 by a position decision member (not shown) arranged on the intermediate transfer unit 40. A contact pressure between the secondary transfer roller 51 and the intermediate transfer belt 41 is maintained by a position decision roller bearing (not shown) arranged in the secondary transfer roller 51. When the secondary transfer roller 51 contacts the intermediate transfer belt 41, a transfer bias having an opposite polarity to that of the toner is applied to the secondary transfer roller 51, and then the superimposed toner image (hereinafter referred to as the toner image) is transferred onto the transfer paper.

On the other hand, when the image forming operation starts, the transfer paper is fed from a transfer paper cassette 80 or a manual feed tray 83, and stopped at a nip formed by a pair of registration rollers 82. When the tip of the toner image formed on the intermediate transfer belt 41 comes to meet the secondary transfer roller 51, the registration rollers 82 start to drive so that the tip of the transfer paper meets the tip of the toner image, resulting in position alignment of the transfer paper and the toner image. The toner image formed on the intermediate transfer belt 41 is superimposed on the transfer paper, and then the transfer paper passes a secondary transfer region. The transfer paper is charged by applying a transfer bias to the secondary transfer roller 51, and therefore almost all of the toner image is transferred onto the transfer paper. And then the transfer paper having the toner image thereon is fed to the fixing unit 60. The toner image is melted and fixed at a nip formed between a fixing belt 61 controlled to a predetermined temperature and a pressing roller 62. The transfer paper is discharged from the main body of the machine, and stacked on a discharging tray 84 face down. Thus, a full color copy is obtained.

When a duplex printing is performed, the transfer paper passed through the fixing unit 60 is fed to the duplex printing paper reversing unit 70 by a duplex printing switch pick 65. In the duplex printing paper reversing unit 70, the transfer paper is guided in a direction indicated by an arrow D by the reversing switch pick 71. After the rear end of the transfer paper passes through the reversing switch pick 71, a pair of reversing rollers 72 stops rotating to stop the transfer paper. The pair of reversing rollers 72 then starts to rotate in the reverse direction after a pause for a predetermined time, and then the transfer paper starts to switchback. At that time, the reversing switch pick 71 switches so that the transfer paper is fed to the pair of registration rollers 82. The reversed transfer paper is stopped at a nip formed between the registration rollers 82. The pair of registration rollers 82 then timely drives to feed the transfer paper to the secondary transfer region. And then the toner image is transferred onto the other side of the transfer paper from the intermediate transfer belt 41. After the toner image is melted and fixed in the fixing unit 60, the transfer paper is discharged from the main body of the machine.

On the other hand, the surface of the photoreceptor belt 11 is cleaned by the photoreceptor cleaning device 12 after the primary transfer process. The surface of the photoreceptor belt 11 may be uniformly diselectrified using a discharging lamp so as to be cleaned easily. After transferring the toner image onto the transfer paper, the surface of the intermediate transfer belt 41 is cleaned by thrusting the cleaning brush 42*a* of the belt cleaning device 42 thereto using the attach/detach mechanism. Toner particles removed from the intermediate transfer belt 41 are accumulated in a waste toner tank 49.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Titanium-Containing Catalyst

In a reaction vessel equipped with a condenser, a stirrer, and a nitrogen inlet pipe capable of submerged bubbling, 1,617 parts of a titanium diisopropoxybis(triethanolaminato) and 126 parts of ion-exchange water are fed, and then gradually heated to 90° C., while performing a submerged bubbling of nitrogen gas. The mixture is subjected to a hydrolysis reaction four 4 hours at 90° C. Thus, a titanium dihydroxybis (triethanolaminato) is prepared.

Preparation of Binder Resin (A)

Synthesis Example 1

The following components are fed in a four-necked separable flask equipped with a stirrer, a thermometer, a nitrogen inlet pipe, a condenser, and a cooling tube.

| | |
|---|---|
| Polyoxypropylene(2,2)-2,2-bis(4-hydroxyphenyl)propane | 740 g |
| Polyoxyethylene(2,2)-2,2-bis(4-hydroxyphenyl)propane | 300 g |
| Dimethyl terephthalate | 466 g |
| Isododecenyl succinic anhydride | 80 g |
| tri-n-Butyl 1,2,4-benzenetricarbonate | 114 g |
| Titanium dihydroxybis(triethanolaminato) | 3 g |

The mixture is reacted for 8 hours at 210° C. under nitrogen atmosphere, and then reacted for 5 hours at 210° C. under a reduced pressure.

Thus, a polyester resin (A-1) including components having a molecular weight of not greater than 500 in an amount of 3.8% by weight, and having a main peak molecular weight of 7,300, a glass transition temperature (Tg) of 62° C., a molecular weight distribution (Mw/Mn) of 5.2, an acid value of 2.1 mgOH/g, and a temperature at which the apparent viscosity measured by a flow tester is 103 Pa·s of 113° C. is prepared.

Synthesis Example 2

The following components are fed in a four-necked separable flask equipped with a stirrer, a thermometer, a nitrogen inlet pipe, a condenser, and a cooling tube.

| | |
|---|---|
| Polyoxypropylene(2,2)-2,2-bis(4-hydroxyphenyl)propane | 640 g |
| Polyoxyethylene(2,2)-2,2-bis(4-hydroxyphenyl)propane | 640 g |
| Isophthalic acid | 500 g |
| Isooctenyl succinic acid | 65 g |
| 1,2,4-benzenetricarbonate | 85 g |
| Titanyl bis(triethanolaminato) | 3 g |

The mixture is subjected to a reaction under the conditions mentioned in the Synthesis Example 1 except that the reaction time is reduced.

Thus, a polyester resin (A-2) including components having a molecular weight of not greater than 500 in an amount of 3.6% by weight, and having a main peak molecular weight of 3,800, a glass transition temperature (Tg) of 61° C., a molecular weight distribution (Mw/Mn) of 2.9, an acid value of 9.3 mgOH/g, and a temperature at which the apparent viscosity measured by a flow tester is 103 Pa·s of 116° C. is prepared.

Synthesis Example 3

The procedure for preparing the polyester resin (A-1) in Synthesis Example 1 is repeated except that the components are replaced with those of the polyester resin (A-2) prepared in Synthesis Example 2.

Thus, a polyester resin (A-3) including components having a molecular weight of not greater than 500 in an amount of 2.2% by weight, and having a main peak molecular weight of 8,800, a glass transition temperature (Tg) of 62° C., a molecular weight distribution (Mw/Mn) of 4.8, an acid value of 10.0 mgOH/g, and a temperature at which the apparent viscosity measured by a flow tester is 103 Pa·s of 118° C. is prepared.

Synthesis Example 4

The procedure for preparing the polyester resin (A-1) in Synthesis Example 1 is repeated except that the components are replaced with the following components.

| | |
|---|---|
| Polyoxypropylene(2,2)-2,2-bis(4-hydroxyphenyl)propane | 710 g |
| Polyoxyethylene(2,2)-2,2-bis(4-hydroxyphenyl)propane | 665 g |
| Isophthalic acid | 640 g |
| Isooctenyl succinic acid | 140 g |
| Titan tetraisopropoxide | 5 g |

Thus, a polyester resin (A-4) including components having a molecular weight of not greater than 500 in an amount of 4.9% by weight, and having a main peak molecular weight of 8,800, a glass transition temperature (Tg) of 68° C., a molecular weight distribution (Mw/Mn) of 8.6, an acid value of 23.4 mgOH/g, and a temperature at which the apparent viscosity measured by a flow tester is 103 Pa·s of 127° C. is prepared.

Preparation of Binder Resin (B)

Synthesis Example 5

The procedure for preparing the polyester resin (A-1) in Synthesis Example 1 is repeated except that the components are replaced with the following components.

| | |
|---|---|
| Polyoxypropylene(2,2)-2,2-bis(4-hydroxyphenyl)propane | 740 g |
| Polyoxyethylene(2,2)-2,2-bis(4-hydroxyphenyl)propane | 180 g |
| Glycerin | 165 g |
| Dimethyl terephthalate | 640 g |
| Titanium dihydroxybis(triethanolaminato) | 3 g |

Thus, a polyester resin (B-1) having a main peak molecular weight of 9,800, a glass transition temperature (Tg) of 62° C., an acid value of 3.3 mgOH/g, and a temperature at which the apparent viscosity measured by a flow tester is 103 Pa·s of 124° C. is prepared.

Synthesis Example 6

The procedure for preparing the polyester resin (A-1) in Synthesis Example 1 is repeated except that the components are replaced with the following components.

| | |
|---|---|
| Polyoxypropylene(2,2)-2,2-bis(4-hydroxyphenyl)propane | 959 g |
| Glycerin | 150 g |
| Dimethyl terephthalate | 645 g |
| Dodecenyl succinic acid | 85 g |
| 1,2,4-benzenetricarbonate | 115 g |
| Titanium dihydroxybis(triethanolaminato) | 3 g |

Thus, a polyester resin (B-2) having a main peak molecular weight of 9,300, a glass transition temperature (Tg) of 65° C., an acid value of 10.1 mgOH/g, and a temperature at which the apparent viscosity measured by a flow tester is 103 Pa·s of 129° C. is prepared.

Synthesis Example 7

The procedure for preparing the polyester resin (A-1) in Synthesis Example 1 is repeated except that the components are replaced with the following components.

| | |
|---|---|
| Polyoxypropylene(2,2)-2,2-bis(4-hydroxyphenyl)propane | 1240 g |
| Dimethyl terephthalate | 660 g |
| 1,2,4-benzenetricarbonate | 45 g |
| Titanyl bis(triethanolaminato) | 3 g |

Thus, a polyester resin (B-3) having a main peak molecular weight of 8,900, a glass transition temperature (Tg) of 63° C., an acid value of 5.2 mgOH/g, and a temperature at which the apparent viscosity measured by a flow tester is 103 Pa·s of 127° C. is prepared.

Synthesis Example 8

The procedure for preparing the polyester resin (A-1) in Synthesis Example 1 is repeated except that the components are replaced with the following components.

| | |
|---|---|
| 1,6-Hexanediol | 320 g |
| Dimethyl terephthalate | 810 g |
| 1,2,4-benzenetricarbonate | 105 g |
| Titanium dihydroxybis(triethanolaminato) | 3 g |

Thus, a polyester resin (B-4) having a main peak molecular weight of 9,200, a glass transition temperature (Tg) of 61° C., an acid value of 12.5 mgOH/g, and a temperature at which the apparent viscosity measured by a flow tester is 103 Pa·s of 130° C. is prepared.

Synthesis Example 9

The procedure for preparing the polyester resin (A-1) in Synthesis Example 1 is repeated except that the components are replaced with the following components.

| | |
|---|---|
| Polyoxypropylene(2,2)-2,2-bis(4-hydroxyphenyl)propane | 1280 g |
| Dimethyl terephthalate | 650 g |
| 1,2,4-benzenetricarbonate | 100 g |
| Titan tetraisopropoxide | 5 g |

Thus, a polyester resin (B-5) having a main peak molecular weight of 9,500, a glass transition temperature (Tg) of 61° C., an acid value of 8.7 mgOH/g, and a temperature at which the apparent viscosity measured by a flow tester is 103 Pa·s of 130° C. is prepared.

Preparation of Charge Controlling Resin

Synthesis Example 10

At first, 610 parts of 3,4-dichlorophenyl maleimide and 105 parts of perfluorooctane sulfonic acid are subjected to a copolymerization for 8 hours in dimethylformamide (DMF) at the boiling point thereof using di-tert-butyl peroxide as an initiator. Next, 310 parts of n-butyl acrylate is added thereto, and the mixture is subjected to a graft polymerization for 4 hours using di-tert-butyl peroxide as an initiator. The DMF is removed from the mixture by a reduced-pressure drier.

Thus, a charge controlling resin (C-1) having a temperature at which the apparent viscosity measured by a flow tester is 104 Pa·s of 96° C. is prepared.

Synthesis Example 11

At first, 600 parts of m-nitrophenyl maleimide and 100 parts of 2-acrylamide-2-methylpropane sulfonic acid are subjected to a copolymerization for 8 hours in dimethylformamide (DMF) at the boiling point thereof using di-tert-butyl peroxide as an initiator. Next, 250 parts of 2-ethylhexyl acrylate is added thereto, and the mixture is subjected to a graft polymerization for 4 hours using di-tert-butyl peroxide as an initiator. The DMF is removed from the mixture by a reduced-pressure drier.

Thus, a charge controlling resin (C-2) having a temperature at which the apparent viscosity measured by a flow tester is 104 Pa·s of 83° C. is prepared.

Synthesis Example 12

At first, 380 parts of 3,4-dichlorophenyl maleimide and 100 parts of 2-acrylamide-2-methylpropane sulfonic acid are subjected to a copolymerization for 8 hours in dimethylformamide (DMF) at a boiling point thereof using di-tert-butyl peroxide as an initiator. The DMF is removed from the mixture by a reduced-pressure drier.

Thus, a charge controlling resin (C-3) having a number average molecular weight of 7,500 is prepared.

Example 1

The following components are mixed using a HENSCHEL MIXER.

| | |
|---|---|
| Polyester resin (A-1) | 80 parts |
| Polyester resin (B-2) | 20 parts |
| Colorant (C.I. Pigment Blue 15:3) | 5 parts |
| Charge controlling agent (BONTRON ® PBE-84 from Orient Chemical Industries, Ltd) | 3 parts |
| Low-molecular-weight polypropylene | 5 parts |

The mixture is kneaded using a two-roll mill, the surface of which is set to 105° C., for 30 minutes and then rolled and cooled. The rolled mixture is subjected to a coarse pulverization, and then a fine pulverization using a jet-mill pulverizer (I-2 mill from Nippon Pneumatic Mfg. Co., Ltd.). The pulverized particles are classified using a rotational airflow classifier (DS classifier from Nippon Pneumatic Mfg. Co., Ltd.). Thus, mother toner particles having a weight average particle diameter of 6.9 μm, and including particles having a weight average particle diameter of not greater than 4 μm in an amount of 9.5% by number are prepared.

The mother toner particles are mixed with 1.0% by weight of a hydrophobized silica (H2000 having a BET specific surface area of 120 $m^2/g$, manufactured by Clariant Japan K. K.) using a HENSCHEL MIXER. Thus, a toner (T-1) is prepared.

Examples 2 to 10, Comparative Examples 1 to 5

The procedure for preparation of the toner in Example 1 is repeated except that the components are changed to those for toners (T-2) to (T-15) described in Table 1, respectively.

Thus, toners (T-2) to (T-15) are prepared.

TABLE 1

| | | Binder resin (A) | | Binder resin (B) | | | External Additive 1 | | External Additive 2 | |
|---|---|---|---|---|---|---|---|---|---|---|
| | Toner | Polyester | parts | Polyester | parts | CCA(*) | Hydrophobized silica | parts | Hydrophobized silica | parts |
| Ex. 1 | T-1 | A-1 | 80 | B-2 | 20 | PBE-84 | H2000 | 1.0 | — | — |
| Ex. 2 | T-2 | A-1 | 60 | B-2 | 40 | PBE-84 | H2000 | 1.0 | — | — |
| Ex. 3 | T-3 | A-1 | 65 | B-3 | 35 | PBE-84 | H2000 | 1.0 | — | — |
| Ex. 4 | T-4 | A-2 | 70 | B-1 | 30 | C-1 | H2000 | 1.0 | — | — |
| Ex. 5 | T-5 | A-2 | 70 | B-1 | 30 | C-1 | H2000 | 1.0 | — | — |
| Ex. 6 | T-6 | A-2 | 70 | B-1 | 30 | C-1 | H2000 | 1.0 | — | — |
| Ex. 7 | T-7 | A-2 | 70 | B-1 | 30 | C-2 | H2000 | 1.0 | RX-50 | 1.2 |
| Ex. 8 | T-8 | A-2 | 80 | B-1 | 20 | C-2 | H3004 | 1.0 | RY-50 | 1.5 |
| Ex. 9 | T-9 | A-3 | 80 | B-1 | 20 | C-3 | H3004 | 1.0 | NX-90 | 1.2 |
| Ex. 10 | T-10 | A-3 | 65 | B-1 | 35 | C-3 | H1303VP | 1.0 | — | — |
| Comp. Ex. 1 | T-11 | A-1 | 50 | B-2 | 50 | PBE-84 | H2000 | 1.0 | — | — |
| Comp. Ex. 2 | T-12 | A-1 | 90 | B-1 | 10 | PBE-84 | H2000 | 1.0 | — | — |
| Comp. Ex. 3 | T-13 | A-2 | 70 | B-4 | 30 | PBE-84 | H2000 | 1.0 | — | — |
| Comp. Ex. 4 | T-14 | A-4 | 80 | B-5 | 20 | PBE-84 | H2000 | 1.0 | — | — |
| Comp. Ex. 5 | T-15 | A-4 | 65 | B-5 | 35 | PBE-84 | H2000 | 1.0 | RY-50 | 1.5 |

(*)Charge controlling agent

Evaluation

Pulverization Property

In each of the toner manufacturing processes of Examples and Comparative Examples, the weight average particle diameter of the fine-pulverized particles, which are pulverized using a jet-mill pulverizer (I-2 mill from Nippon Pneumatic Mfg. Co., Ltd.) under a fixed condition, is measured. The index of the pulverization property is defined as the ratio of the weight average particle diameter of the fine-pulverized particles to that of Example 1. As the ratio decreases, the pulverization property increases. When the ratio is not less than 1.3, such a toner is not suitable for practical use.

Fixable Temperature Range

Each of the above-prepared toner (i.e., one-component developer) is set in a full-color laser printer IPSIO COLOR 5000 (manufactured and modified by Ricoh Co., Ltd.), which is modified so that a toner can be supplied with a cartridge and the fixing temperature can be varied. The IPSIO COLOR 5000 includes a non-magnetic one-component developing unit including a developing sleeve consisting of a coated elastic body and a toner layer controlling member consisting of a stainless blade.

A coping paper TYPE 6200 (manufactured by Ricoh Co., Ltd.) is set in the above printer, and images having a toner in an amount of 80 $g/cm^2$ are produced thereon at various temperatures. The produced images are visually observed to determine a minimum fixable temperature below which the cold offset problem occurs and a maximum fixable temperature above which the hot offset problem occurs. The fixable temperature range is defined as the difference between the minimum and maximum fixable temperatures. When the fixable temperature range is less than 50° C., such a toner is not suitable for practical use.

Running Test

A running test in which 50,000 copies of an image having an image proportion of 5% are continuously produced and then 30,000 copies of an image having an image proportion of 0% are continuously produced is performed (i.e., 80,000 copies are produced in total). The toner cartridge is replaced with a new one after 10,000 copies and 80,000 copies are produced. The developing unit is replaced with a new one after every 10,000 copies are produced.

After 10,000 copies, 50,000 copies, and 80,000 copies are produced, the following evaluations are performed.

(1) Charge Quantity

The charge quantity of toner particles present on the developing sleeve is measured by a tribo-aspiration method.

(2) Background Fouling

Toner particles remaining on the photoreceptor after an image is developed are adhered to a tape. The image densities of the blank tape and the tape having toner particles are measured using X-RITE 938, and the difference therebetween is calculated. As the difference becomes larger, the occurrence of background fouling increases. (This evaluation is also performed after replacing the toner cartridge with a new one after 80,000 copies are produced.)

(3) Toner Film

The developing sleeve, the toner layer controlling member, and the photoreceptor are visually observed whether a toner film is formed thereon or not, and evaluated as follows:

Good: No toner film is observed.

Average: A streaky toner film is observed.

Poor: Toner films are observed over all.

(4) Image Quality and Overall Evaluation

The image quality is evaluated after 50,000 copies and 80,000 copies are produced, and replacing the toner cartridge with a new one after 80,000 copies are produced. In addition, the overall evaluation is performed considering the above evaluation results, and graded as follows:

Very good

Good

Average

Poor

The evaluation results are shown in Tables 2, 3A, and 3B.

TABLE 2

| | Toner | Pulverization property index | Fixable temperature range (° C.) |
|---|---|---|---|
| Ex. 1 | T-1 | 0.98 | 55 |
| Ex. 2 | T-2 | 0.77 | 60 |
| Ex. 3 | T-3 | 0.81 | 50 |
| Ex. 4 | T-4 | 0.96 | 60 |
| Ex. 5 | T-5 | 0.95 | 60 |
| Ex. 6 | T-6 | 0.95 | 60 |
| Ex. 7 | T-7 | 0.94 | 60 |
| Ex. 8 | T-8 | 0.99 | 60 |
| Ex. 9 | T-9 | 0.98 | 60 |
| Ex. 10 | T-10 | 0.82 | 60 |
| Comp. Ex. 1 | T-11 | 0.70 | 60 |
| Comp. Ex. 2 | T-12 | 1.43 | 50 |
| Comp. Ex. 3 | T-13 | 1.27 | 60 |
| Comp. Ex. 4 | T-14 | 1.31 | 55 |
| Comp. Ex. 5 | T-15 | 0.82 | 60 |

TABLE 3A

| | | After 10,000 copies | | After 50,000 copies | | | |
|---|---|---|---|---|---|---|---|
| | Toner | Charge quantity (−μC/g) | Back-ground fouling | Charge quantity (−μC/g) | Back-ground fouling | Toner film | Image quality |
| Ex. 1 | T-1 | 20.5 | 0.01 | 20.8 | 0.01 | Good | Very good |
| Ex. 2 | T-2 | 23.1 | 0.01 | 22.1 | 0.02 | Good | Very good |
| Ex. 3 | T-3 | 23.6 | 0.01 | 20.5 | 0.03 | Good | Very good |
| Ex. 4 | T-4 | 20.6 | 0.01 | 19.1 | 0.02 | Good | Very good |
| Ex. 5 | T-5 | 22.4 | 0.01 | 22.7 | 0.02 | Good | Very good |
| Ex. 6 | T-6 | 20.8 | 0.01 | 18.7 | 0.02 | Good | Very good |
| Ex. 7 | T-7 | 24.7 | 0.01 | 23.4 | 0.01 | Good | Very good |
| Ex. 8 | T-8 | 22.2 | 0.01 | 21.9 | 0.01 | Good | Very good |
| Ex. 9 | T-9 | 25.3 | 0.01 | 24.1 | 0.01 | Good | Very good |
| Ex. 10 | T-10 | 23.6 | 0.01 | 21.8 | 0.01 | Good | Very good |
| Comp. Ex. 1 | T-11 | 19.2 | 0.02 | 12.3 | 0.07 | Good | Poor |
| Comp. Ex. 2 | T-12 | 18.6 | 0.03 | 19.3 | 0.05 | Good | Poor |
| Comp. Ex. 3 | T-13 | 20.9 | 0.01 | 18.0 | 0.05 | Poor | Poor |
| Comp. Ex. 4 | T-14 | 21.4 | 0.01 | 15.6 | 0.09 | Poor | Poor |
| Comp. Ex. 5 | T-15 | 23.1 | 0.02 | 17.4 | 0.04 | Average | Average |

TABLE 3B

| | | After 80,000 copies | | | | After replacing toner cartridge | | |
|---|---|---|---|---|---|---|---|---|
| | | Charge quantity (−μC/g) | Background fouling | Toner film | Image quality | Background fouling | Image quality | Overall evaluation |
| Ex. 1 | T-1 | 17.6 | 0.02 | Average | Good | 0.05 | Average | Good |
| Ex. 2 | T-2 | 15.0 | 0.03 | Average | Good | 0.06 | Average | Good |
| Ex. 3 | T-3 | 13.8 | 0.05 | Average | Average | 0.07 | Average | Average |
| Ex. 4 | T-4 | 17.9 | 0.02 | Good | Very good | 0.05 | Average | Good |
| Ex. 5 | T-5 | 20.1 | 0.03 | Good | Good | 0.06 | Average | Good |
| Ex. 6 | T-6 | 16.3 | 0.03 | Good | Good | 0.05 | Average | Good |
| Ex. 7 | T-7 | 22.8 | 0.01 | Good | Very good | 0.01 | Very good | Very good |
| Ex. 8 | T-8 | 21.4 | 0.01 | Good | Very good | 0.01 | Very good | Very good |
| Ex. 9 | T-9 | 22.8 | 0.02 | Good | Very good | 0.03 | Good | Good |
| Ex. 10 | T-10 | 21.6 | 0.02 | Good | Very good | 0.05 | Good | Good |
| Comp. Ex. 1 | T-11 | Evaluation is stopped | | — | — | — | — | Poor |
| Comp. Ex. 2 | T-12 | Evaluation is stopped | | — | — | — | — | Poor |

TABLE 3B-continued

| | | After 80,000 copies | | | | After replacing toner cartridge | | |
|---|---|---|---|---|---|---|---|---|
| | | Charge quantity (−μC/g) | Background fouling | Toner film | Image quality | Background fouling | Image quality | Overall evaluation |
| Comp. Ex. 3 | T-13 | Evaluation is stopped | | — | — | — | — | Poor |
| Comp. Ex. 4 | T-14 | Evaluation is stopped | | — | — | — | — | Poor |
| Comp. Ex. 5 | T-15 | 15.4 | 0.08 | Poor | Poor | — | — | Poor |

This document claims priority and contains subject matter related to Japanese Patent Application No. 2006-075529, filed on Mar. 17, 2006, the entire contents of which are incorporated herein by reference.

Having now fully described the invention, it will be apparent to one of ordinary skill in the art that many changes and modifications can be made thereto without departing from the spirit and scope of the invention as set forth therein.

The invention claimed is:

1. A toner, comprising:

a colorant;

a binder resin (A) comprising a polyester resin having no tetrahydrofuran insoluble component, and having a molecular weight distribution such that components having a molecular weight of not greater than 500 are included in an amount of not greater than 4% by weight, based on the weight of the polyester resin, and a peak is present in a molecular weight range of from 3,000 to 9,000 when measured by gel permeation chromatography (GPC); and a binder resin (B) comprising a polyester resin having no tetrahydrofuran insoluble component, and comprising units of a polycarboxylic acid and a diol having the following formula (1):

(1)

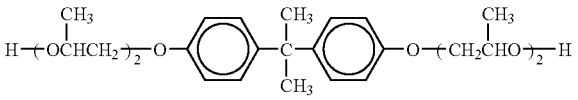

wherein at least one of the binder resins (A) and (B) is prepared in the presence of, and the toner comprises, at least one titanium comprising catalyst selected from the group consisting of a titanium catalyst of formula (2), $$Ti(—X)_m(—OH)_n \quad (2)$$

a titanium catalyst of formula (3), $$O{=}Ti(—X)_p(—OR)_q \quad (3)$$

and combinations thereof, wherein X represents a residue group of a mono- or poly-alkanolamine from which a hydrogen atom is removed from one hydroxyl group, wherein, when X is a poly-alkanolamine, one or more additional hydroxyl groups, that do not include the one hydroxyl group from which the hydrogen atom is removed, of the poly-alkanolamine may, optionally, be subjected to an intramolecular polycondensation with a hydroxyl group directly bound to a Ti atom to which the residue group X is bound so as to form a ring structure, or an intermolecular polycondensation with a hydroxyl group directly bound to another Ti atom so as to form a repeating structure, wherein the repeating structure has a polymerization degree of from 2 to 5;

R represents a hydrogen atom or an alkyl group having 1 to 8 carbon atoms which, optionally, may have 1 to 3 ether bonds;

m represents an integer of 1 to 4;

n represents an integer of 0 to 3;

a sum of m and n is 4;

p represents an integer of 1 or 2;

q represents and integer of 0 or 1;

wherein a sum of p and q is 2, and when each of m and p is 2 or more, each of X may be the same or different; and wherein a weight ratio ((A)/(B)) of the binder resin (A) to the binder resin (B) is from 60/40 to 85/15.

2. The toner according to claim 1, wherein a main peak molecular weight of the binder resin (B) when measured by GPC is larger than that of a main peak molecular weight of the binder resin (A) when measured by GPC.

3. The toner according to claim 2, wherein the main peak molecular weight of the binder resin (B) is from 1.1 to 2.0 times that of the main peak molecular weight of binder resin (A) when measured by GPC.

4. The toner according to claim 1, further comprising a charge controlling agent.

5. The toner according to claim 4, wherein the charge controlling agent is a negative charge controlling resin comprising constitutional units of a first monomer comprising a sulfonate group;

a second monomer comprising a phenyl maleimide or phenyl itaconimide monomer substituted with a chlorine atom or a nitro group;

a third monomer comprising at least one selected from the group consisting of an acrylate monomer, a methacrylate monomer, and combinations thereof; and optionally, a fourth monomer comprising an aromatic vinyl monomer.

6. The toner according to claim 5, wherein the negative charge controlling resin comprises constitutional units of, based on the weight of the resin, the first monomer an amount of from 1 to 30% by weight, the second monomer in an amount of from 1 to 80% by weight, the third monomer in an amount of from 10 to 80% by weight, and the fourth monomer in an amount of from 0 to 30% by weight.

7. The toner according to claim 1, further comprising an external additive.

8. The toner according to claim 7, wherein the external additive comprises 2 or more external additives, each of which has a different particle diameter.

9. The toner according to claim 7, wherein the external additive comprises an external additive having a BET specific surface area of from 30 to 80 $m^2/g$.

10. The toner according to claim 8, wherein the external additive comprises an external additive having a BET specific surface area of from 30 to 80 $m^2/g$ and another external additive having a BET specific surface area of from 100 to 250 $m^2/g$.

11. A developer, comprising the toner according to claim 1 and a carrier.

12. A developing device, comprising:

a developing unit configured to supply a toner to an image forming part;

a toner cartridge configured to supply the toner to the developing unit, comprising a first rotation member configured to agitate and transport the toner and a projection arranged on an inner wall thereof;

a hopper configured to temporary trap the toner supplied from the toner cartridge to the developing unit, comprising a second rotation member configured to agitate and transport the toner;

at least one opening configured to pass the toner between the toner cartridge and the developing unit; and at least one control valve configured to open and shut the at least one opening, wherein the control valve accelerates supplying the toner from the toner cartridge to the hopper by contacting the second rotation member, and the projection accelerates discharging the toner from the hopper to the toner cartridge by contacting the first rotation member, and wherein the toner is the toner according to claim 1.

13. An image forming apparatus, comprising:

an image bearing member configured to bear an electrostatic latent image thereon;

an electrostatic latent image forming device configured to form the electrostatic latent image on the image bearing member;

a developing device configured to develop the electrostatic latent image with a toner to form a toner image;

a transfer device configured to transfer the toner image onto a transfer member; and a fixing device configured to fix the toner image to the transfer member, wherein the developing device comprises:

a developing unit configured to supply the toner to an image forming part;

a toner cartridge configured to supply the toner to the developing unit, comprising a first rotation member configured to agitate and transport the toner and a projection arranged on an inner wall thereof;

a hopper configured to temporary trap the toner supplied from the toner cartridge to the developing unit, comprising a second rotation member configured to agitate and transport the toner;

at least one opening configured to pass the toner between the toner cartridge and the developing unit; and at least one control valve configured to open and shut the at least one opening, wherein the control valve accelerates supplying the toner from the toner cartridge to the hopper by contacting the second rotation member, and the projection accelerates discharging the toner from the hopper to the toner cartridge by contacting the first rotation member, and wherein the toner is the toner according to claim 1.

14. An image forming method, comprising:

forming an electrostatic latent image on an image bearing member;

developing the electrostatic latent image with a toner to form a toner image;

transferring the toner image onto a transfer member;

fixing the toner image to the transfer member, wherein the developing comprises:

supplying the toner to the electrostatic latent image formed on the image bearing member by rotating a developing roller comprising a developing blade configured to control a thickness of a toner layer so as to contact or come close to the image bearing member, and wherein the toner is the toner according to claim 1.

15. The toner of claim 1, wherein the polyester resin in the binder resin (A) has a molecular weight distribution such that components having a molecular weight of not greater than 500 are comprised therein in an amount of from 1% to 4% by weight, based on the weight of the polyester resin.

16. The toner of claim 1, wherein the weight ration ((A)/(B)) of the binder resin (A) to the binder resin (B) is from 70/30 to 80/20.

17. The toner of claim 1, comprising the titanium-comprising catalyst of formula (2).

18. The toner of claim 17, wherein in the titanium-comprising catalyst of formula (2), wherein m is an integer of from 1 to 3.

19. The toner of claim 1, comprising the titanium-comprising catalyst of formula (3).

20. The toner of claim 1, comprising the titanium-comprising catalysts of formula (2) and formula (3).

* * * * *